US012239881B1

(12) United States Patent
Schaefer et al.

(10) Patent No.: US 12,239,881 B1
(45) Date of Patent: Mar. 4, 2025

(54) SYSTEM AND METHOD FOR INTERFACING TO AN EXERCISE MACHINE

(71) Applicants: Philip Raymond Schaefer, Weaverville, NC (US); Ethan Storm Williams, Alma, AR (US)

(72) Inventors: Philip Raymond Schaefer, Weaverville, NC (US); Ethan Storm Williams, Alma, AR (US)

( * ) Notice: Subject to any disclaimer, the term of this patent is extended or adjusted under 35 U.S.C. 154(b) by 172 days.

(21) Appl. No.: 17/722,323

(22) Filed: Apr. 16, 2022

Related U.S. Application Data

(60) Provisional application No. 63/176,258, filed on Apr. 17, 2021.

(51) Int. Cl.
*A63B 24/00* (2006.01)

(52) U.S. Cl.
CPC ..... *A63B 24/0006* (2013.01); *A63B 24/0062* (2013.01); *A63B 24/0087* (2013.01); *A63B 2024/0015* (2013.01); *A63B 2024/0068* (2013.01); *A63B 2024/0096* (2013.01); *A63B 2220/50* (2013.01)

(58) Field of Classification Search
CPC ..... A63B 24/0006; A63B 24/0062; A63B 24/0087; A63B 2024/0015; A63B 2024/0068; A63B 2024/0096; A63B 2220/50
See application file for complete search history.

(56) References Cited

U.S. PATENT DOCUMENTS

| | | | | |
|---|---|---|---|---|
| 6,672,157 | B2 | 1/2004 | MacFarlane et al. | |
| 7,628,737 | B2 | 12/2009 | Kowallis et al. | |
| 7,874,957 | B2 | 1/2011 | Hurwitz et al. | |
| 7,981,000 | B2 | 7/2011 | Watterson et al. | |
| 8,251,874 | B2 | 8/2012 | Ashby et al. | |
| 10,111,589 | B2 | 10/2018 | Kirby et al. | |
| 2009/0011907 | A1* | 1/2009 | Radow | B62M 3/00 482/57 |
| 2009/0098980 | A1* | 4/2009 | Waters | A63B 22/02 463/43 |
| 2015/0251055 | A1 | 9/2015 | Ashby | |
| 2016/0166879 | A1* | 6/2016 | Dilli | A63B 22/02 482/8 |
| 2019/0247707 | A1 | 8/2019 | Agree et al. | |
| 2019/0344123 | A1* | 11/2019 | Rubin | A63B 21/0058 |
| 2021/0113885 | A1* | 4/2021 | Maresh | A63B 22/0292 |
| 2021/0134425 | A1* | 5/2021 | Mason | A63B 24/0062 |
| 2021/0205660 | A1* | 7/2021 | Shavit | G06V 40/23 |

FOREIGN PATENT DOCUMENTS

CN 107866037 A * 4/2018

* cited by examiner

*Primary Examiner* — Sundhara M Ganesan
*Assistant Examiner* — Jacqueline N L Loberiza

(57) ABSTRACT

A system measures data output by a sensor collecting data from an exercise machine. Based on the signals received from the sensor, the system extracts information about the angular positions and angular velocities of moving components of the exercise machine, and the system estimates resistance settings and power outputs of the exercise machine. The results of these measurements and estimates are used to provide feedback to a user of the exercise machine, to record and share the workout data from using the exercise machine, and/or to control the behavior of a virtual object in a virtual environment.

17 Claims, 19 Drawing Sheets

SYSTEM AND METHOD FOR INTERFACING TO AN EXERCISE MACHINE

CROSS-REFERENCE TO RELATED APPLICATIONS

This application claims the benefit of U.S. Provisional Application 63/176,258, filed Apr. 17, 2021.

FIELD OF INVENTION

This invention relates generally to providing an electronic device to measure and/or control the operation of an exercise machine in order to provide realistic measurements, feedback, and/or simulated workout environments, and more particularly to devices that measure the speed, power, and other parameters of an exercise machine in order to provide interfacing signals that enable the above features.

BACKGROUND OF THE INVENTION

Many people like to work out indoors. In recent years, exercise bikes, treadmills, stair steppers, rowing machines, and elliptical exercise products have been sold and many are purchased both for in-home and in-gym use.

To make the use of such machines more interesting, some manufacturers have introduced simulation or game-playing environments that interface to the machines. These products have built-in sensors that measure the apparent speed and the force levels being used in the exercise, since many such products have resistance controls to make it harder or easier to move the machine. Commercial examples include the Zwift™ environment, which provides computer-generated social interactions for cycling trainers and treadmills, the Elite Real™ environment, which provides for simulated cycling using recorded video sequences from real roads and trails, and products available on Nordictrack™ and Bowflex™ products.

Many exercise machines have electronic or mechanical means to modify the resistance level of the exercise. For example, a cycling simulator can increase the resistance felt by the user to simulate the effects of going uphill or cycling into a strong headwind.

On machines thus equipped, it is possible to interface the sensors and actuators on the exercise machine to a processor or processing device such as a computer, tablet, or cellphone, so that the screen of the device shows a game or simulated environment. Connection to the internet is possible as well, so that multiple players or exercisers can appear in a shared environment.

These capabilities are currently available mainly on higher-end machines. However, many thousands of people have purchased less-expensive exercise machines and may wish to enjoy similar features. These machines, however, don't have the built-in sensors or actuators to connect to games or other virtual workout experiences, or to share or record workout data. It would be possible to wire-in interfaces to such products, but most people do not have the requisite skills, and it may be impractical for a business to retrofit these machines with the hardware to do such interfacing.

Some prior art has addressed certain aspects of the desirability to interface exercise machines to interesting simulations, instruction, or other interactive systems to make exercise use more interesting. One approach is to provide mechanisms to impart realistic resistance changes to an exercise machine. For example, U.S. Pat. No. 7,874,957 to Hurwitz et al. discloses an approach to add an external friction device to an exercise machine to enable simulation of situations such as hills. Similarly, U.S. Pat. No. 8,251,874 to Ashby et al. discloses an invention to cause a treadmill to tilt in response to simulated terrain. U.S. Pat. No. 7,981,000 to Watterson et al. provides a concept for sending signals that control operating parameters of the exercise machine.

Other prior art describes approaches to measure some of the operating parameters of an exercise machine. For example, U.S. Patent Application 2015/0251055 of Ashby counts cycles of a treadmill belt. U.S. Patent 10, 111,589 to Kirby et al. discloses receiving oxygen or speed inputs from a user, and discusses calculating critical velocity and critical power, and critical speed values. Some prior art describes inventions to measure power in an exercise machine. For example, U.S. Patent 6,672, 157 to MacFarlane et al. discloses a technique for measuring the time required to move a mass between 2 points, then calculating the power. U.S. Patent Application 2019/0247707 A1 of Lagree et al. claims an exercise machine with a rail. It measures position of a carriage on the rail and then feeds back information from that. U.S. Pat. No. 7,628,737 to Kowallis et al. discloses an electricity generator that is coupled to a moveable element of the exercise machine. However, little in the prior art describes practical means to measure power or work output performed with the existing resistance mechanisms in a non-modified exercise machine.

Therefore, it is of significant benefit to create a simple device to update or retrofit existing low-cost exercise machines with the capability of interacting with various simulation and game environments, including the ability to include in the workout environment the power output, resistance level, simulated changes in terrain, and speed in the interactions.

OBJECTS AND ADVANTAGES OF THE PRESENT INVENTION

Therefore, several objects and advantages of the present advantage are:

To provide a simple means to collect data about workouts from exercise machines using readily available sensors.

To provide a simple means to interface an exercise machine with gaming or simulation environments.

To make the interfacing to gaming or simulation environments possible as an add-on feature to exercise machines that are manufactured without such interface capabilities.

To measure and/or control the resistance level of an exercise machine, so that realistic variations such as hills and headwinds can be experienced by the user of the machine.

To provide these features without a requirement to directly interface to the electronics or operating software of these machines, and optionally, without the need of attaching external resistance or actuation devices to the machines.

SUMMARY OF THE INVENTION

The subject invention is a system that receives sensor signals from sensors in contact with or observing motion of or around an exercise machine. The system computes information about the exercise, such as the revolutions per minute, power output, resistance level, calories burned, etc. This information is then formatted for use in various possible ways, such as for participating in a workout class, controlling travel in a simulated environment, gathering fitness statistics about the user, etc.

In a simple embodiment of the present invention, the gathered data are simply displayed to the user in real time. In another embodiment of the present invention, the data are collected into a standard format and used for online workout data sharing, possibly in social networking environments.

In another embodiment of the present invention, the data are converted into workout data packets, such as standards known in the art, for example Bluetooth and ANT+ workout data protocols. These data are used to interact with systems, such as virtual environments that are designed to interface to such data.

In another embodiment of the present invention, the system is used to retrofit an existing exercise machine to enable it to have the smart connectivity features available from measuring and transmitting exercise data.

DESCRIPTION OF THE PREFERRED EMBODIMENTS

Figure 1:
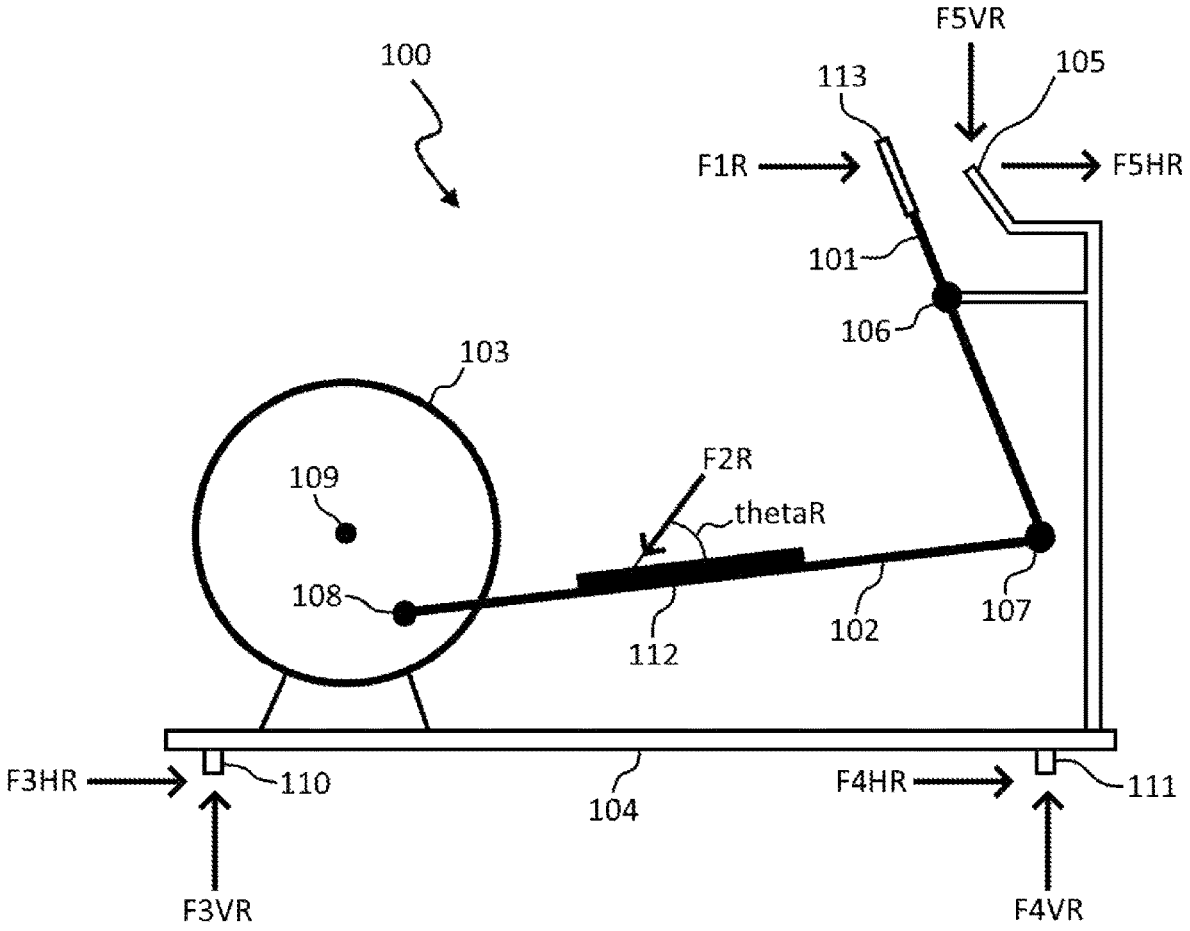
FIG. 1 depicts a force diagram depicting an example portion of an elliptical exercise machine.

This Specification uses the term "machines" to mean "exercise machines", for example elliptical trainers, cycling trainers, stair steppers, ski machines, rowing machines, and treadmills.

The Specification refers to a cycle of action on a machine as a "revolution", "cycle", or similar terminology herein. Examples include strides or revolutions of the belt in a treadmill, rotations of the pedals on an elliptical, stair-stepper, or cycling trainer, cycles of pulling on a ski machine, or the pulls on the simulated oars on a rowing machine. Various definitions of the "cycle" on a given machine may be used with equivalent results. Multiplications may be represented herein as the factors next to each other, for example, x y=z indicates that x and y are multiplied.

For embodiments of the present invention that involve simulating an actual or imaginary entity and its behavior in a virtual or simulated environment, the term "virtual object" is used. The term can refer to any vehicle, bicycle, elliptical bicycle, boat, plane, etc., or even to a human body moving through space, in the sense that power and energy are used by the body to propel through space, using physics similar to those used to propel the other types of "virtual objects." The virtual object and environment may also correspond to entities involved in hitting targets, playing music, watching videos, attending classes, or other systems where the behaviors of a virtual object are controlled or affected by the user's actions on the exercise machine.

In this Specification, there are numerous processes, equations, algorithms, and decisions described. Each of these can alternately be implemented as any combination of all or part of an analog circuit, a digital circuit, firmware instructions residing on a microcontroller, or software residing in an app or program that runs on any processing device, such as custom electronics circuit board or boards, a computer, a portable device such as a smartphone, tablet, or watch, or another type of processing device.

Many of the examples provided herein are related to an Elliptical exercise machine, as it is a popular machine. It should be understood that the scope of the concepts, equations, and of the present invention in general is not limited to this machine, and encompasses many other categories of exercise machines. Applying the methods and specifics of the equations described herein to other machines is within the scope of the present invention and will be apparent to those of skill in the art, based on the specification provided herein.

Below are exemplary embodiments of the invention used to interface to exercise machines:

Measuring Speed and Revolution Rate

If there is a wheel or belt, simply counting revolutions of the wheel or belt to provide the revolution rate will be apparent to those with skill in the art. Possible sensors include magnetic, optical, mechanical indexing, etc. Additional sensors, such as accelerometers, gyroscopes/angular rate sensors, or gyrometers, are used in some embodiments to measure the speed and revolution rate of a wheel.

Alternately, cycles in the variation of forces or positions of pedals, linkages, or other moving parts of the machine are used in alternate embodiments of the present invention to infer the revolution rate and from it, the apparent speed of the machine.

If the machine is manufactured to provide these types of outputs, they of course are used in embodiments of the present invention.

Measuring Resistance Level

In this Specification, the term "resistance" is used to identify the concept of the difficulty, or force required to perform the exercise on the machine, and may correspond to weight, mass, incline, or other similar concept, depending on the specifics of the machine, and be within the scope of what is described herein about the present invention. Measuring the power generated by the exercise may be used in some embodiments of the present invention, to be converted to and from resistance using known relationships of power, force, velocity, and work. In this Specification, the term "workout intensity" output is used to signify the power, energy, or resistance output of the present invention, or a function related to these quantities, that is needed to measure not only the steps and cadence (repetition rate) of an exercise, but also the energy being expended and work being done in the exercise. As described elsewhere herein, it is possible to convert between these various quantities if the angular rate of the machine is known, so it should be kept in mind that since it is typically straightforward to measure the angular rates of components of an exercise machine, it will be equivalent to solve for power, energy, or resistance, etc., then to convert to the alternate workout-intensity quantities as needed within the invention or to interface to external systems. Using the concepts herein, these workout intensity relationships and conversions will be apparent to those of skill in the art.

Force sensors are positioned on the pedals and/or handles in one embodiment of the present invention. With these inputs, the net forces are calculated and used. Bicycle pedals are currently manufactured that have such built-in sensors for estimating power. For an add-on feature, pads with built-in sensors may be attached to the surfaces of non-instrumented pedals and handles of existing machines.

In another embodiment, acoustic sensors (e.g., microphones) listen to the machine for the sounds of motors controlling the resistance, or for sounds associated with the stresses and strains acting upon the machine as a function of the exercise taking place. The sounds typically increase in duration or amplitude as a function of increasing resistance.

In another embodiment, vibration sensors infer the level of resistance, since the machine is likely to move about more when high resistance levels are being used.

In another embodiment, magnetic field sensors infer the positioning of permanent or electro-magnets for those machines in which magnets are utilized to vary resistance via eddy-current effects.

In yet another embodiment of the present invention, a heat sensor is used to measure heat accumulated by virtue of the resistance mechanism of the machine.

In another embodiment, force sensors are used on the floor, or between the feet of the machine and the floor. These can be measuring vertical compressive forces, horizontal compressive forces, or shear forces. Optionally, the force sensors do not need to be attached to the machine, and rely on the weight of the machine to transfer the needed forces to the sensor.

In another embodiment, strain gauges are mounted at specific locations on the machine to measure the force applied by the user.

In yet another embodiment, rotational sensors, for example, rotational position, velocity, or acceleration sensors measure rotational accelerations and infer resistance or power values from calibrations that relate these quantities.

If the machine is manufactured to provide these types of outputs, they of course are used in embodiments of the present invention.

Controlling Resistance Level

Actuators are used in some embodiments of the present invention to turn control knobs or press buttons to control the resistance level.

Instructions can be given to the user to operate the machine controls to control the resistance level.

In one embodiment, control is achieved by physically wiring in a signal and actuator, such as a motor, linear actuator, stepper motor, solenoid to vary an existing resistance control electrically. Alternately, also electrically controlled brake pads are added to moving elements of the machine to effect such control.

If the machine is manufactured to accept these types of inputs, they of course are used in embodiments of the present invention.

Technique for Substituting for the Control of Resistance by Using the Measurement of Resistance For many machines, it may be easier to infer the resistance level than to control it. The present invention has provisions for interfacing to a simulation, game, or other workout experience that is or is not expecting to control resistance level, without actually controlling the resistance level.

In this embodiment, the machine preferably operates in a manual mode, where the user can control the resistance level manually, with a knob, up/down buttons, etc. The manual resistance control is thought of as a gear shift of sorts, that is, when the resistance is increased, the virtual "gearing" is increased, and the virtual object moves proportionally faster in a game or simulation, or performs the virtual task with modified skill level, speed, or intensity, due to the increased effort per revolution. Alternately, a pre-defined resistance profile may be used, for example to ensure the workout contains a range of resistance levels, speeds, etc. And as above, the behavior, for example, speed, of the virtual object is varied depending on the resistance level.

When a simulation or game sends a command to the machine to increase the resistance, for example, during a simulated uphill, instead of actually increasing resistance, this embodiment of the invention instead decreases the distance traveled per revolution of the machine. This is equivalent to the gear shift being automatically reduced when the workout calls for increased resistance settings, such as uphills. So the effect is that, given the same manual resistance setting and the same pedaling speed, when the uphill occurs, the virtual object in the simulated environment will slow down. If the user wishes to go faster up that hill, they will need either to move (e.g., pedal) the mechanism faster, or to "upshift" by increasing the resistance level.

Similarly, the distance per revolution is increased when the simulation or game commands for a decrease in resistance.

The end result is that the user experiences similar realism as if the resistance were being changed. The main thing that is different is that the machine appears to automatically upshift and downshift in response to changes in difficulty. To make the experience of the automated gear shift as realistic as possible, additional feedback is optionally provided in an embodiment of the present invention, including one or more of the following:

- A sound effect, such as that of a motor, that changes its frequency according to the gear shift.
- A verbal prompt indicating the gear shift.
- A sound effect, vibration, or other event that simulates discrete changes to gear shift, rather than a gradual, continuous change
- Visual display items that show the gear shift
- A very obvious display of speed, such as a dial, or versions of the above gear-shift-related indicators, such that when the gears are shifted, it is very clear that the speed changes dramatically.

Even without such enhancements, it should be clear to the user that a change in the speed of the simulated terrain, course, etc. has occurred on the basis of information displayed on a user interface of the machine or of the invention.

Alternate embodiments of the present invention do not contain a simulation or game as part of the workout experience. For example, an experience such as a workout class may simply specify resistance levels to be used in various portions of the workout. The data items corresponding to the change in resistance are modified analogously to the above velocity-based description. Similarly, alternate embodiments display data such as speed, power, RPMs, calories, etc., and may share workout data in real time, or in databases without specifically affecting the motion of a virtual object in a virtual environment. It should be understood that the processing techniques described herein for embodiments that do affect motion of a virtual object in a simulation, game, etc., may equivalently be used for such purposes in these alternate embodiments of the present invention.

Calculating the Applied Power, Work, or Energy by Using Force Sensors.

A mechanical model of the machine in question is used in a preferred embodiment as the basis for building a mapping between the sensor forces and the torques, forces, work, speed, etc. of parts of the machine, eventually resulting in computation of the simulated speed of a virtual object, power output produced or applied, and/or the resistance level of the machine.

One simple model based on an Elliptical workout machine is shown herein as an example, but similar models can be constructed for other machines, as will be apparent to those of skill in the art. The provided models and diagrams may be imperfect, but are shown as exemplary of the kinds of forces and structures that are involved in embodiments of the present invention, and the usage of the example forces and equations constitutes but one example embodiment of the present invention.

FIG. 1 shows a depiction of the mechanical parts of an Elliptical machine 100, including the forces acting upon it. Only the right half of the machine is shown for simplicity. The left half is nearly identical, but with the lower left linkage corresponding to lower right linkage 102 being attached more or less radially opposite to the right wheel connection point 108 of lower right linkage 102 on wheel 103. Upper right pivot 106 and lower right pivot 107 allow upper linkage 101 and lower linkage 102 to move as wheel 103 rotates. Similar diagrams can readily be generated to include the moving and fixed members of other types of exercise machines, as will be apparent to those of skill in the art.

Force F1R is the user's force on the right moving handle 113. Force F5HR is the horizontal force on the right fixed handle 105, and force F5VR is the vertical force on the right fixed handle 105. F2R is the force of the user's right foot on the lower right linkage 102, via pedal 112 and is directed at an angle thetaR from the line defined by lower right linkage 102. On the left side, there are corresponding forces F1L, F5HL, F5VL, F2L, and angle thetaL, although these are not shown in FIG. 1.

Force F3VR is the vertical force from the right rear foot of the machine on the floor and F3HR is the horizontal force from the right rear foot of the machine on the floor. Force F4VR is the vertical force from the right front foot of the machine on the floor and F4HR is the horizontal force from the right front foot of the machine on the floor. On the left side, there are corresponding forces F4VR, F4HR, F4VL, and F4VR, although these are not shown in FIG. 1.

This description indicates the forces and or force sensors as being on or with respect to a floor, but the floor is just one example of a support surface or support point. Alternate embodiments may equivalently measure the force between any other support surfaces or support points, as will be apparent to those of skill in the art. Forces may alternately be measured between components of the exercise machine, such as between a foot and a base, or between bearings and the base.

Figure 2:
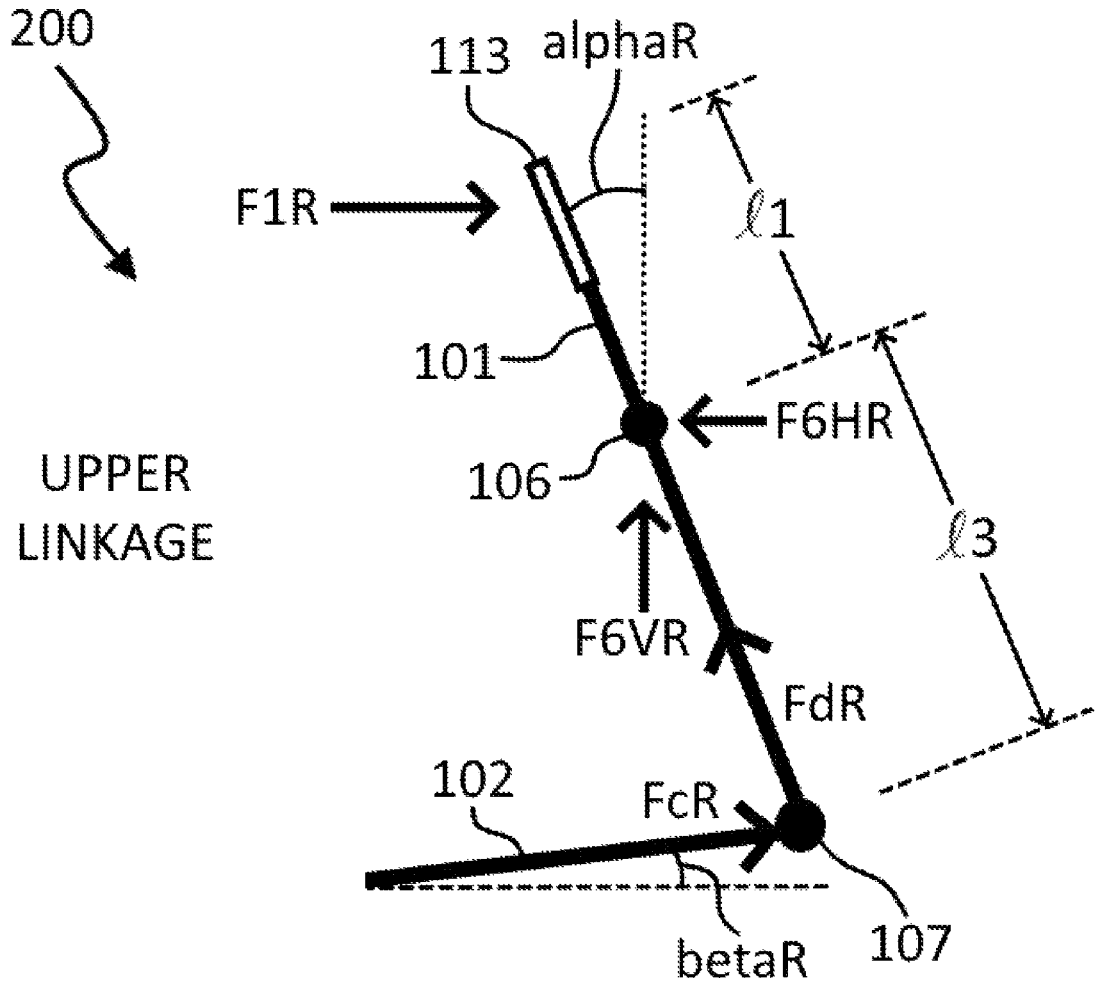
FIG. 2 depicts a diagram of an example upper right linkage of an elliptical exercise machine.

FIG. 2 shows the upper right linkage 101 and the forces acting upon it. In addition to the forces shown in FIG. 1, F6HR is the horizontal force from upper right pivot 106 and F6VR is the vertical force from upper right pivot 106. Force FOR is the longitudinal force and FcR is the perpendicular end force on 101 imparted from lower right linkage 102, via lower right pivot 107. The length of linkage 101 from upper right pivot 106 to its top is L1, whereas the length of linkage 101 from upper right pivot 106 to lower right pivot 107 is L3. Angle alphaR is the angle of the upper right linkage 101 with respect to the vertical. Angle betaR is the angle of lower right linkage 102 with respect to the horizontal. (Note that in some cases, this Specification shows the label of a link with an uppercase "L", whereas the drawings may have a lowercase. This is to avoid confusion of the lowercase letter with the number 1. These alternate labels are intended to be equivalent.)

Similar forces act on the upper left linkage, and are herein termed F6HL, F6VL, FdL, and FcL, with similar angles alphaL and betaL.

The equations of the forces acting on the upper right linkage are:

$$F1R-F6HR-FdR \sin(\text{alphaR})+FcR \cos(\text{betaR})=0 \quad \text{(horizontal forces,equation 1)}$$

$$F6VR+FdR \cos(\text{alphaR})+FcR \sin(\text{betaR})=0 \quad \text{(vertical forces,equation 2)}$$

$$-F1R \cos(\text{alphaR})L1+FcR \cos(\text{alphaR-betaR})L3=0 \quad \text{(torque,equation 3)}$$

Equations of similar form represent the forces on the upper left linkage, as will be apparent to those of skill in the art.

Figure 3:
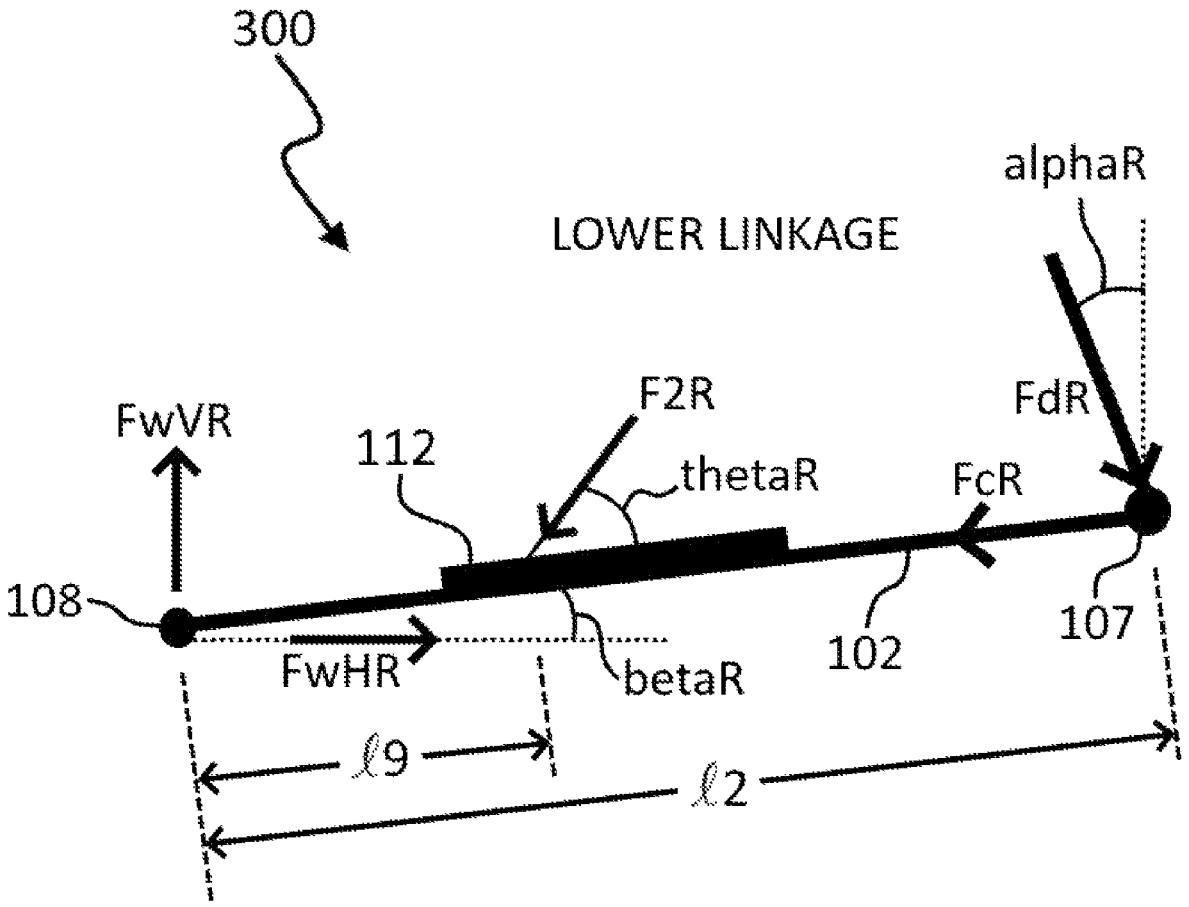
FIG. 3 depicts a force diagram of an example lower right linkage of an elliptical exercise machine.

FIG. 3 shows the lower right linkage 102 and the forces acting upon it. In addition to the forces described previously, FwVR is the vertical force and FwHR is the horizontal force from the right wheel connection point 108 onto the left end of linkage 102. The length of lower right linkage 102 is L2 and the distance from connection point 108 to the point of foot force F2R action on pedal 112 is L9.

Similar forces will act on the lower left linkage, and will be termed F2L, FwVL and FwHL.

The equations of the forces acting on the lower right linkage are:

$$\text{FwHR}-F2R \cos(\text{thetaR+betaR})+FdR \sin(\text{alphaR})-fcR \cos(\text{betaR})=0 \quad \text{(horizontal forces,equation 4)}$$

$$\text{FwVR}-F2 \sin(\text{thetaR+betaR})-FdR \cos(\text{alphaR})-fcR \sin(\text{betaR})=0 \quad \text{(vertical forces,equation 5)}$$

$$-FdR \cos(\text{alphaR-betaR})L2-F2R \sin(\text{thetaR})L9=0 \quad \text{(torque,equation 6)}$$

Equations of similar form will represent the forces on the lower left linkage, as will be apparent to those of skill in the art.

Figure 4:
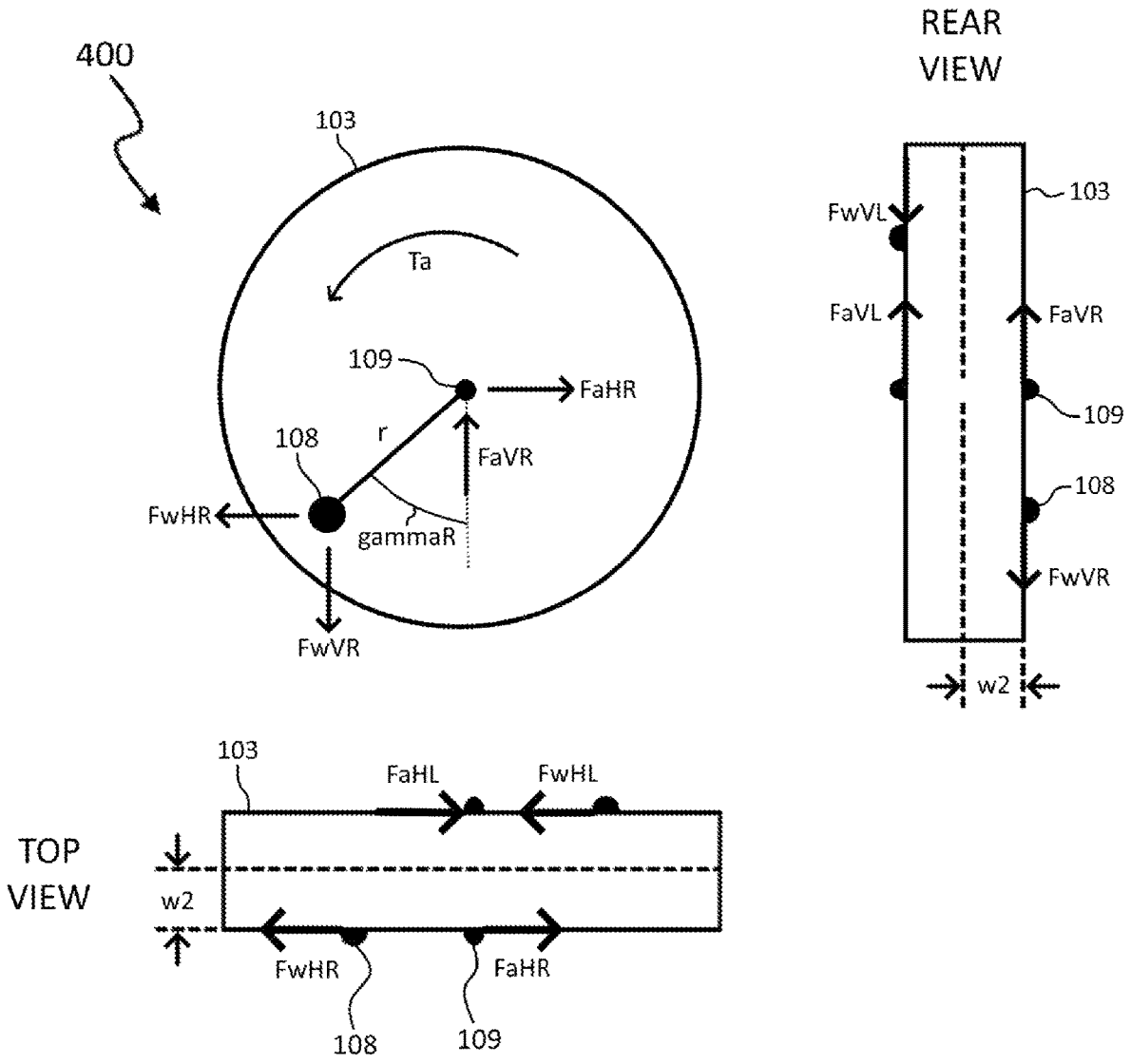
FIG. 4 depicts an example wheel of an elliptical exercise machine, along with forces acting upon it.

FIG. 4 shows the wheel 103 of the Elliptical and the forces acting upon it. Angle gammaR is the angle of wheel 103 with respect to its position when right wheel connection point 108 is in its lowest position. In addition to the forces described previously, force FaHR is the horizontal force and FaVR is the vertical force from axle 109 on the right mount of axle 109. gammaDot is the derivative of gammaR, in other words, the angular velocity of wheel 103. gammaDot may correspond to the rotation frequency of the main flywheel in an elliptical, the pedals of a bike trainer, or to another desired part of the exercise machine mechanism that undergoes repetitive motions. gammaDotDot is the second derivative of gammaR, in other words, the angular acceleration of wheel 103. The distance from the front/rear centerline of wheel 103 to the right and left axle mounts 109 is w2. The radial distance of the connection point 108 from the axis 109 is r.

As will be apparent to those of skill in the art, gammaL will be offset from gammaR by 180 degrees, and similar forces FaHL and FaVL will be present on the left side of wheel 103.

rho is the resistance to turning of wheel 103. In the preferred embodiment, rho is modeled as proportional to gammaDot, with rho times gammaDot representing the resistive torque opposing motion, although other models of resistance may be used in alternate embodiments, as will be apparent to those of skill in the art. The angular moment of inertia constant I is used in the preferred embodiment to model the torque effects of the mass of wheel 103, but likewise, other models are used in alternate embodiments. DeltaT represents a time step in simulating the physics of motion.

The equations of the forces acting on the wheel are:

$$\text{FaHR}-\text{FwHR}+\text{FaHL}-\text{FwHL}=0 \qquad \text{(horizontal forces,equation 7)}$$

$$\text{FaVR}-\text{FwVR}+\text{FaVL}-\text{FwVL}=0 \qquad \text{(vertical forces,equation 8)}$$

$$\text{FwHR}\cos(\text{gammaR})r-\text{FwVR}\sin(\text{gammaR})r+\text{FwHL}\cos(\text{gammaL})r-\text{FwVL}\sin(\text{gammaL})r-Ta-I\text{gammaDotDot}=0 \qquad \text{(torque viewed from side,equation 9)}$$

$$w2(\text{FwVL}-\text{FwVR}-\text{FaVL}+\text{FaVR})=0 \qquad \text{(torque viewed from rear,equation 10)}$$

$$w2(\text{FaHR}-\text{FaHL}-\text{FwHR}+\text{FwHL})=0 \qquad \text{(torque viewed from above,equation 11)}$$

where $Ta=rho\text{gammaDot}$

Figure 5:
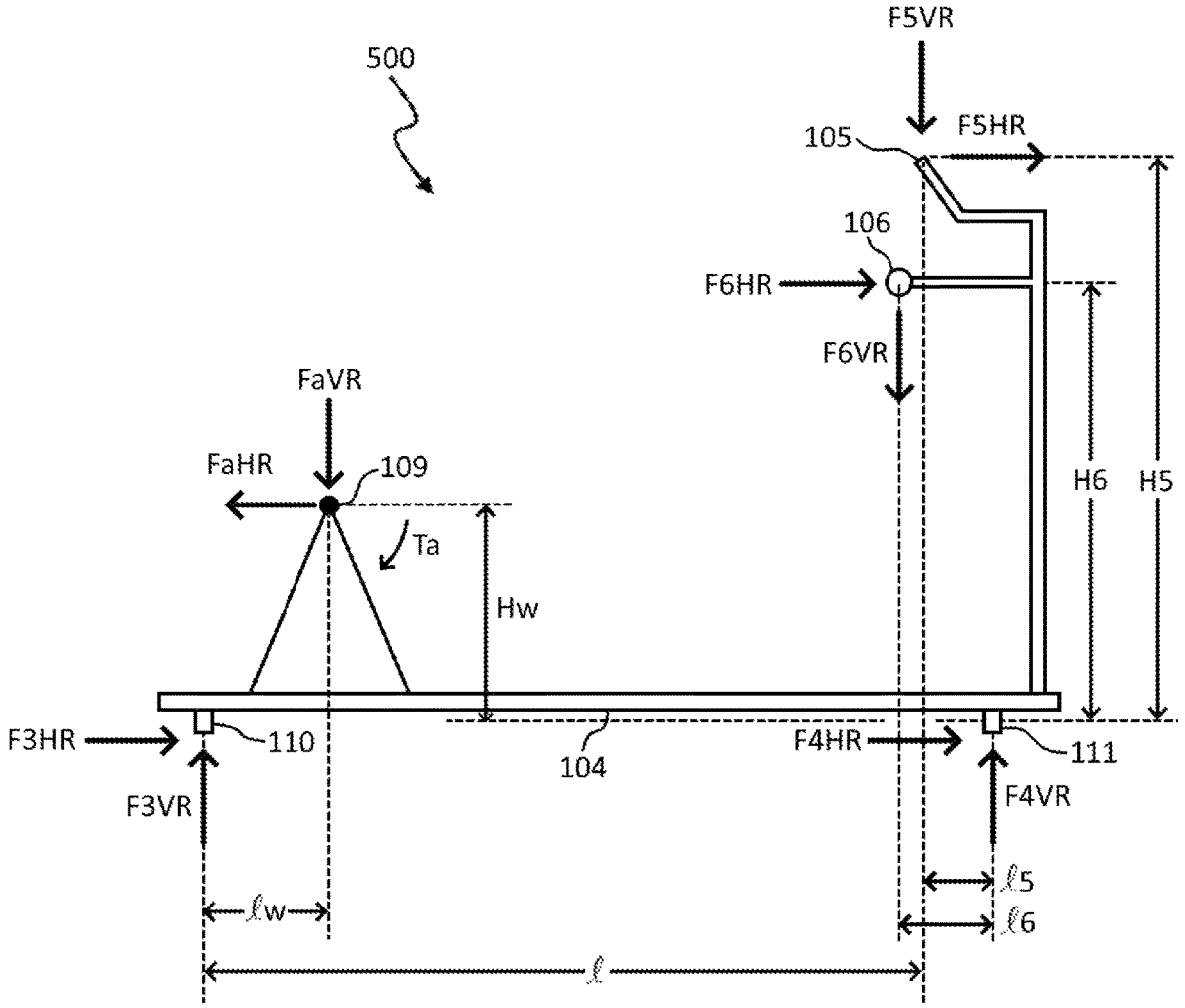
FIG. 5 depicts an example base of an elliptical exercise machine, along with forces acting upon it.

FIG. 5 shows an example base of an Elliptical and the forces acting upon it. The horizontal distance from the rear foot 110 to wheel axle 109 is Lw. The horizontal distance from rear foot 110 to fixed handle 105 is L. The horizontal distance from fixed handle 105 to front foot 111 is L5. The horizontal distance from upper right pivot point 106 to front foot 111 is L6.

The vertical distance from front right foot 111 to wheel axle 109 is Hw. The vertical distance from front right foot 111 to fixed handle 105 is H5. The vertical distance from front right foot 111 to upper right pivot 106 is H6. The horizontal distance from the front/rear centerline of the base to the pedal points on lower linkage 102 is w6. The horizontal distance from the front/rear centerline of the base to the fixed handle 105 is w5. The horizontal distance from the front/rear centerline of the base to front right foot 111 is w4. The horizontal distance from the front/rear centerline of the base to rear right foot 110 is w3. The horizontal distance from the front/rear centerline of the base to the right movable handle is also w6. In FIG. 5, the "L" annotations are omitted for simplicity, since there will be similar R and L vectors, as will be apparent to those of skill in the art.

The equations of the forces acting on the base are:

$$F3HR+F4HR+F5HR+F6HR-\text{FaHR}+F3HL+F4HL+F5HL+F6HL-\text{FaHL}=0 \qquad \text{(horizontal forces,equation 12)}$$

$$F3VR+F3VL+F4VR+F4VL-\text{FaVR}-\text{FaVL}-F5VR-F5VL-F6VR-F6VL=0 \qquad \text{(vertical forces,equation 13)}$$

$$(F6VR+F6VL)L6-(F6HR+F6HL)H6+(F5VR+F5VL)L5-(F5HR+F5HL)H5+(\text{FaVR}+\text{FaVL})(L+L5-Lw)+(\text{FaHR}+\text{FaHL})Hw-(F3VR+F3VL)(L+L5)-Ta=0 \qquad \text{(torque from right about front foot 111,equation 14)}$$

$$(F3VR-F3VL)w3+(F4VR-F4VL)w4-(F6VR-F6VL)w6-(F5VR-F5VL)w5-(\text{FaVR}-\text{FaVL})w2=0 \qquad \text{(torque as viewed from rear,equation 15)}$$

$$(F3HR-F3HL)w3+(F4HR-F4HL)w4+(F5HR-F5HL)w5+(F6HR-F6HL)\quad w6-(\text{FaHR}-\text{FaHL})w2=0 \qquad \text{(torque viewed from top,equation 16)}$$

Overall, the variables in these equations, when the corresponding left-side variables are included are (removing those that can trivially be computed from others with a simple equation):

User inputs (10 variables): F1R, F1L, F5VR, F5VL, F5HR, F5HL, F2R, F2L, thetaR, thetaL.

Other external forces (8 variables): F3HR, F3HL, F3VR, F3VL, F4HR, F4HL, F4VR, F4VL.

Forces within the machine (20 variables): F6HR, F6HL, F6VR, F6VL, FcR, FcL, FdR, FdL, FwHR, FwHL, FwVR, FwVL, FaHR, FaHL, FaVR, FaVL, rho, gamma (gammaL or gammaR), gammaDot, gammaDotDot.

The above equations are provided only as an example of a form and style of possible equations to describe the parts of certain elliptical machines in one embodiment. Similar sets of equations are derived in other embodiments for similar or different configurations of exercise machines, for example, elliptical machines with a front wheel, treadmills, stair step machines, and bicycle trainers, by considering all the moving parts and modeling the mechanism for where the resistance is present, as will be apparent to those of skill in the art.

Measuring and Estimating Angle Parameters

Various options exist within the scope of the present invention to measure or estimate the gamma parameters, i.e., the angle parameters, of the wheel rotation or the cyclical motion of other parts of exercise machine mechanisms. The gamma value, also termed herein as the "exercise machine angle", can correspond to the angle of a flywheel as in the example shown in FIG. 1, or can alternately correspond to the angle of other moving members of the exercise machine, assuming that angle corresponds to a point in the cyclical operation of the machine. Thus the angle calculation techniques for finding gamma are relevant for identifying the current point within the cyclical operation of the machine, for example, identifying when the moving member of the machine is at a defined zero-degrees position. The exercise machine angular rate, equivalent to gammaDot, and related to the cycle frequency of the exercise machine is similarly important. The options within embodiments of the present invention include extracting time-duration and periodicity information from one or more of the various sensor signals, which ultimately constitute time-difference data from which rotation rates are computed, as follows:

For example, in one embodiment of the present invention, a magnet is affixed to the wheel 103, and a magnetic pickup switch, similar to that used on bicycle speedometers, is mounted near the wheel. With one or multiple magnets, angular acceleration can be roughly approximated. It also is feasible in an alternate embodiment to assume that the angular acceleration is constant between the magnetic detections. The entire cycle can thus be measured, and among other things, the frequency of operation, equivalently, for example, gammaDot, is found.

A more accurate embodiment of the invention achieves angle calculation by use of a rotation sensor, such as an angular rate sensor (gyro) and/or accelerometer on the wheel 103, and measures the gamma parameters more directly, as will be apparent to those with skill in the art. The gyro will directly indicate the angular velocity, and the absolute angle can be derived by using an accelerometer to detect when wheel 103 is in a particular orientation, as will be apparent to those with skill in the art.

Figure 6:
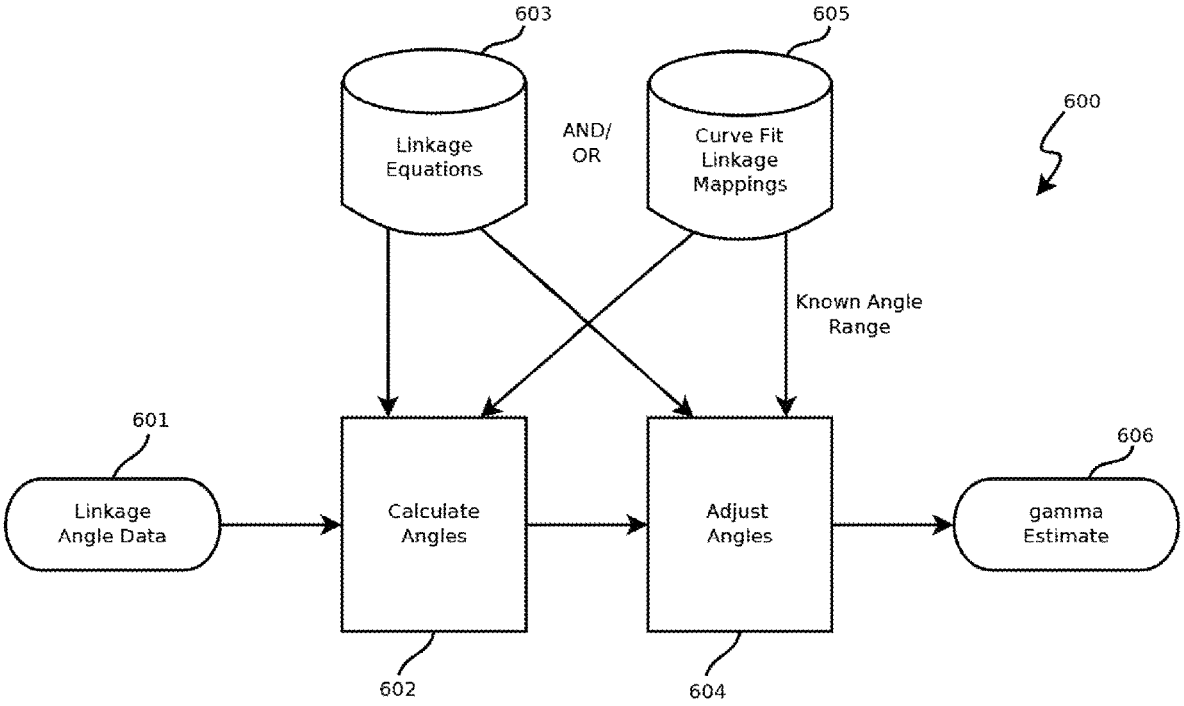
FIG. 6 depicts an example estimator for a rotational angle gamma.

FIG. 6 depicts a gamma estimation process and/or structure 600 used in angle calculation in another embodiment of the present invention. In this embodiment, angle or angular rate sensors are mounted on a linkage, for example on 101 or 102, shown as linkage angle data 601, and then trigonometric equations are used to infer the gamma parameters.

For example, such sensors in preferred embodiments measure or infer values for alphaR, alphaL, betaR, or betaL, or the angular rates thereof, from which gammaR and gammaL values may be computed by the calculate angles module 602 via one or more trigonometric equations describing the layout of for example, the linkages 101, 102, and wheel 103, shown as Linkage equations 603. The advantage of this approach is that a tilt sensor or gyro on a linkage of most machines will enable detection of the absolute angle as well, since there are periodic waveforms that relate, through trigonometric functions, to the absolute angle of the wheel. One disadvantage to inferring gamma from linkage angles is that there are unstable points in the trig solutions to some of these linkages. Another possible disadvantage is that the direction of rotation of the wheel may be more difficult to measure. This is relevant in some cases where users may wish to pedal the machine backwards or forwards. Asymmetries of the angular rate seen over a collection of users are preferably used to determine the direction of rotation.

These equations may be difficult to solve in closed form for gamma, since they involve nonlinear, typically trigonometric functions and terms. In a preferred embodiment, the equations are solved numerically using techniques known in the art, such as gradient descent or Runge-Kutta. Equations such as equations 1 through 6 above are used in a preferred embodiment of the present invention in 602 to numerically calculate the relationship between the linkage angles and the wheel angle gamma. Putting the relevant equations into an iterative numerical equation solver is used in an embodiment of this method, and each iteration provides improved estimates of alpha and beta.

Rather than solving iteratively in real time, a less computationally expensive embodiment for Calculate angles 602 is based on solving the equations for alpha and beta offline, then performing a best fit to more easily evaluated functions, for example a sinusoid. For example, in one embodiment, the following two quantities are minimized, where La=L−Iw, and Lb=h6−hw:

$$La+r\sin(\text{gammaR})-L3\sin(\text{alphaR})-L2\cos(\text{betaR});$$

$$Lb+r\cos(\text{gammaR})-L3\cos(\text{alphaR})-L2\sin(\text{betaR});$$

and the following values are used:

$$r=7.5,\ La=37,\ Lb=27.5,\ L2=36,\ \text{and}\ L3=26.5$$

In this example, a reasonable curve fit results in these equations for alpha and beta:

$$\text{alphaR}=-5-16.5\sin(\text{gammaR}-4.0) \quad \text{(equation 17) and}$$

$$\text{betaR}=1.725+12.08\cos(\text{gammaR}-4.0) \quad \text{(equation 18)}$$

where the angles are in degrees and lengths in inches. An alternate embodiment of the invention collects example data of one or more of alpha, beta, and gamma and then does the curve fitting with experimental data, avoiding the need to implement the iterative solver. In such an embodiment, the example alpha and beta equations are thus experimentally derived as will be apparent to those of skill in the art.

To solve for gammaR, for example using the above results and assuming that the angle alphaR is being measured by a tilt sensor, provides $$\sin(\text{gammaR}-4.0)=(\text{alphaR}+5.0)/-16.5 \quad \text{(equation 19) and}$$

$$\text{gammaR}=\arcsin((\text{alphaR}+5.0)/-16.5)+4.0 \quad \text{(equation 20)}$$

In the example of FIG. 6, these equations are stored in curve fit linkage mapping 605.

The unstable points in solving for gammaR as a function of a linkage angle, for example alphaR or betaR, are addressed in a preferred embodiment by creating a filter that weights the angle derived from the equations vs. an angle derived from extrapolating the previous angular rate of the wheel. Such an unstable point occurs for example in equation 20 when the arcsin result is near 90 degrees, since the sine function changes relatively little with relatively large changes in gamma.

In one preferred embodiment of the present invention, a gyro (angular rate sensor) is used on the linkage instead of an absolute angle sensor as in the above example. This has the advantage of avoiding the effects of linear accelerations that can cause errors in acceleration-based angle sensors. The difficulty, however, is in obtaining the absolute alpha or beta from the derivative. This can cause an offset in the gamma value, and the offset can grow over time due to sensor imperfections. This problem is addressed in the example of FIG. 6 in the optional Adjust angles module 604.

In one embodiment, the gyro sensor output alphaDot is integrated to obtain an estimate for alpha. Since the max and min values of alpha are known, for example from equation 17, the offset of the integration is calculated from the difference between the integration's max and min, versus the known theoretical max and min. Then, the output of the integral is shifted to minimize this error. A simple embodiment shifts the value of alpha by the error amount. A more sophisticated embodiment implements a smoother adjustment, such as a P, I, PI, or PID control loop, that incrementally adjusts the bias to the integration of alpha, as will be apparent to those of skill in the art.

After any implemented angle adjustment in 604 such as in the above description, the gamma estimate 606 is produced.

Other Embodiments of Angle Estimation and Calculation

In yet another embodiment, force, strain, and/or pressure sensors are mounted beneath the feet of the machine (for example 110 or 111) or one or both pedals 112, and the resultant periodic sensor waveform is used to drive at least the angular rate gammaDot, for example, by finding the fundamental frequency of the periodic sensor waveform. Observation of people using the machine as compared to such sensor waveforms can also identify the point at which gamma, (i.e., equivalently gammaR or gammaL, since they will differ only by a constant angle) is equal to zero or other reference angle, as will be apparent to those with skill in the art. In one embodiment of the present invention, the force signal from one foot of the machine is passed through a lowpass filter to help guarantee that one peak value occurs per revolution. Then the maximum or minimum of the filtered signal is used to identify a reference part of the force waveform. A derivation from the equations for the machine, or a study of where the peak occurs as a function of gamma are then used to map the max or min value to a particular value of gamma. Thus, both the exercise machine angle and the exercise machine angular rate are estimated from the sensor signal, potentially avoiding the need of a separate rotation sensor.

An alternate embodiment has a pre-stored reference set of force waveforms for one or more of the force sensors. Each reference force waveform has an identified gamma value for a position within the reference waveform. In use, one or more force waveforms are compared to one or more of the pre-stored reference waveforms, for example, by performing a correlation, convolution, or similar comparison. The best value, such as the maximum correlation to one or more reference waveforms, or a combination, for example, a weighted average, of the reference waveforms, is used to identify a gamma value within the waveform or waveforms from the force sensors.

Figure 7:
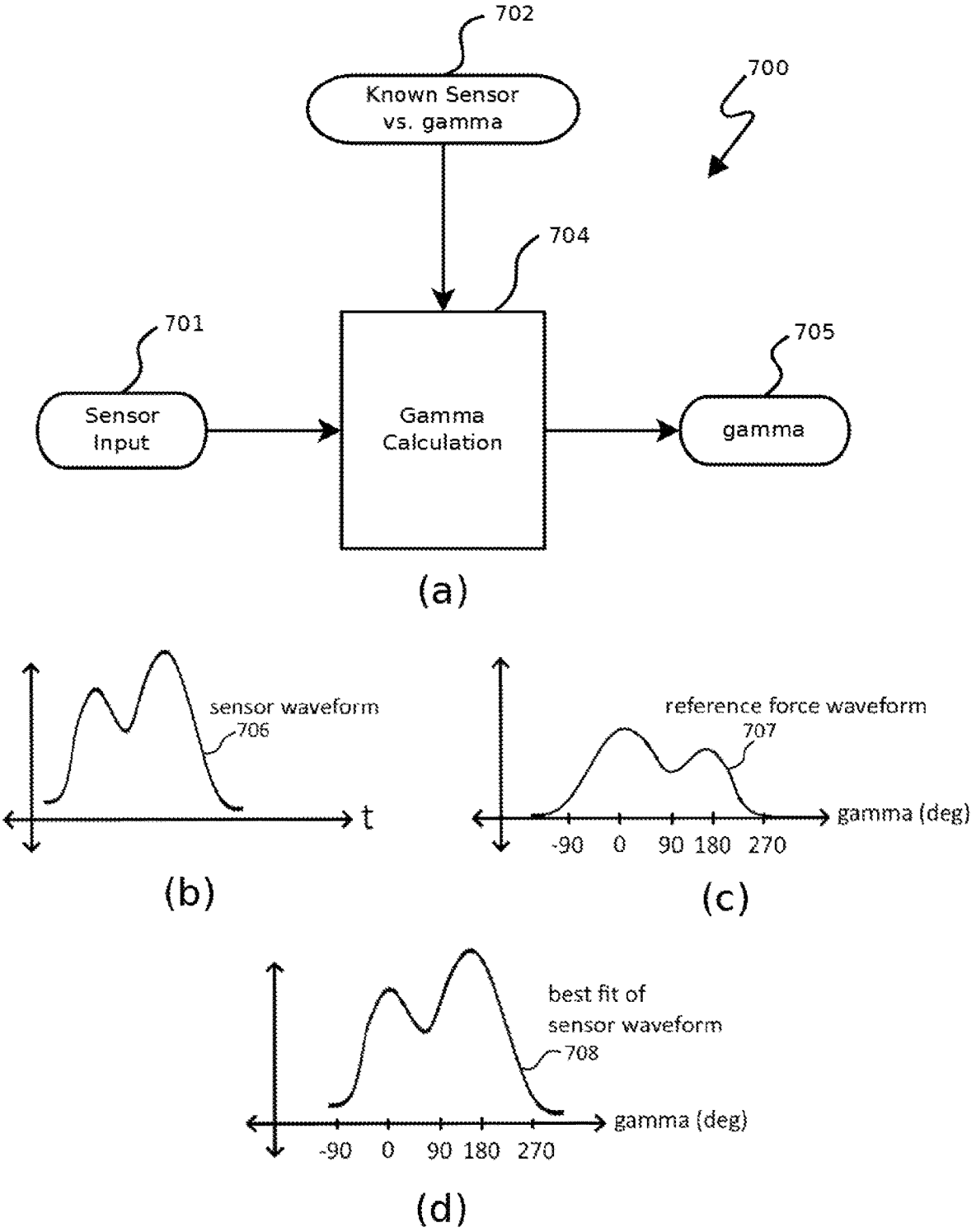
FIG. 7 depicts an example of an angle gamma calculation.

FIG. 7 shows an example of a gamma calculation process 700. In FIG. 7(*a*), the sensor input 701 is compared, using a technique such as a correlation operation, with a known sensor/gamma mapping 702. The best mapping between the two, such as a maximum correlation or convolution operation, results in the output of a gamma value 705 for each point in time, or over intervals of time, as a result of the sensor input 701. In FIG. 7(*b*), sensor waveform 706 is depicted as an example of sensor input 701, and has two peaks, for example from an under-foot force sensor. FIG. 7(*c*) depicts an example reference force waveform 707, and the peaks are not necessarily quantitatively or qualitatively the same as the two peaks in sensor waveform 706. FIG. 7(*d*) depicts an example of a sensor/gamma mapping 702. This mapping is based on Best fit of sensor waveform 708, which depicts an example of the process of providing a gamma value 705, showing the result of scaling and shifting sensor waveform 706 to match reference force waveform 707. Thus, the gamma values for the points in Best fit of sensor waveform 708, and based on the match to sensor/gamma mapping 702, are output as gamma 705, using mathematical techniques that will be apparent to those of skill in the art. Optionally, the matching of sensor input 701 to sensor/gamma mapping 702 may occur in one cycle of the machine operation, and extrapolated for use in the subsequent cycle or cycles of operation, under the assumption that adjacent cycles will be similar, so that the angular rate can be projected forward by extrapolation techniques, e.g., linear extrapolation, that are known in the art. Alternately, there can be a periodic representation of sensor/gamma mapping 702 such that continually, or on a periodic basis, the actual sensor input 701 can be correlated to the periodic representation to compute the current angle.

The pre-stored waveforms corresponding to 702 can be generic waveforms created by the manufacturer, or could be measured from specific users or specific machine models or machines, and either averaged or otherwise combined to provide a prototypical example, or simply a particular waveform may be recorded from the incoming data. Alternately, the pre-stored waveform is derived from a simulation of the machine, using equations and techniques such as described herein.

Determining the direction of rotation of wheel 103 is also more difficult with the force sensor approach then when measuring wheel 103 rotation directly. As above in the angular rate case, "signatures" of the direction of rotation as seen and detected in the force waveforms, may be used to determine which way the wheel is rotating.

Alternately, for either such rotation-determination case, the system could optionally ask the user to specify the direction of motion. Alternately, a simple extra sensor could be used for this purpose, for example by mounting a pattern of multiple magnets near each other on wheel 103 and detecting the temporal pattern. For example, if there is one magnet, then a gap, then two magnets close to each other, the dual-event detection of the 2 magnets before or after the one-event detection of the single magnet, will imply which way wheel 103 is rotating. Similarly, optically-reflective spots or darker spots could be affixed to the wheel, and a reflective optical sensor used to make the determination.

Measuring External Force Parameters

Figure 8:
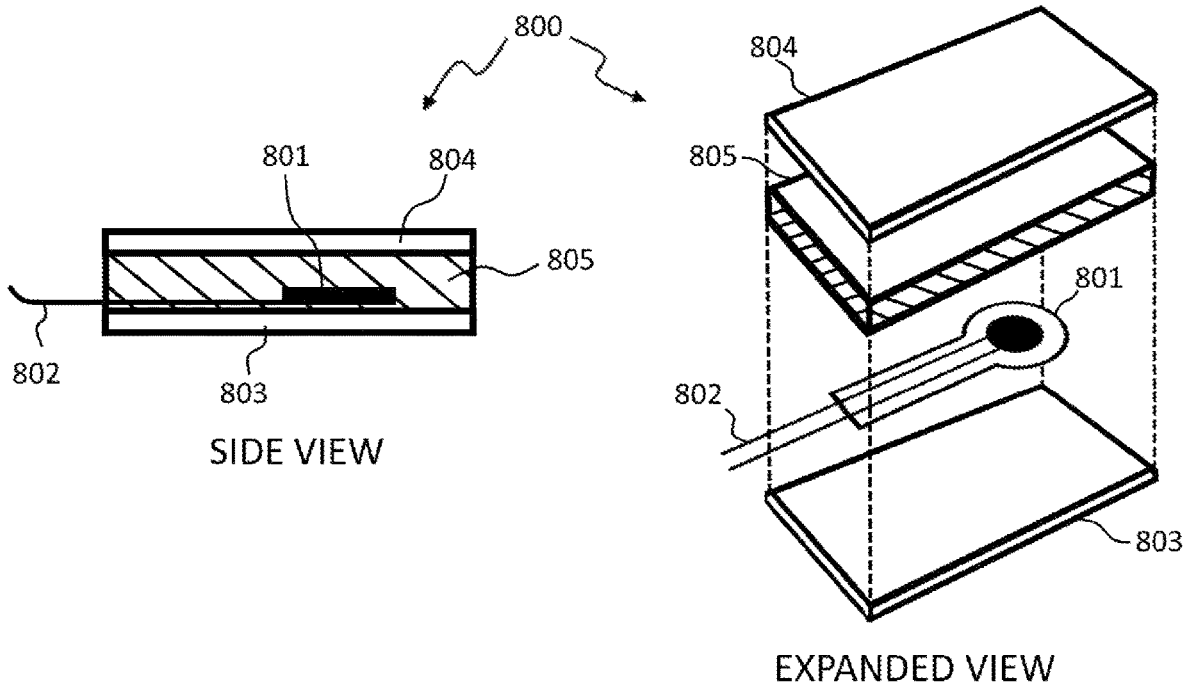
FIG. 8 depicts an example force sensing pad.

The group of forces F3HR, F3HL, F3VR, F3VL, F4HR, F4HL, F4VR, F4VL can be measured or inferred by a variety of means within the scope of the present invention. The sensor elements themselves are varied. For example, the vertical forces can be measured with a load cell or other type of pressure or force sensor. Thin, inexpensive force sensing elements are currently available that are only a few mils thick. These can be used as shown by force sensing pad 800 in FIG. 8. Since the force levels can be several hundred pounds, some means may be necessary to scale down the force seen by the force sensing element 801, with leads 802, since these devices are often are limited to a few pounds full scale. One embodiment does this by making the force sensing pad 800 larger in cross section than the force sensing element 801, making one or both plates 803 and 804 on the outside relatively rigid, and having a slightly compressible material 805 in the middle to distribute the force more evenly. Alternately, multiple force sensors are included in the "sandwich" to reduce the effects of any uneven application of force. These sensor pads can optionally be attached to the bottom of one or more feet of the machine, or optionally simply slid under the one or more feet and would typically stay in a usable location due to the weight of the machine. Other types of force sensing elements are possible, including capacitive sensors whose spacing is affected by the force, or piezoelectric sensors configured such that applied forces cause small deformations and hence electrical outputs.

An alternate embodiment of the invention uses similar force-sensing elements attached to or built into the machine, for example with a retrofit or in production, to eliminate the need for placing an external sensor pad.

Figure 9:
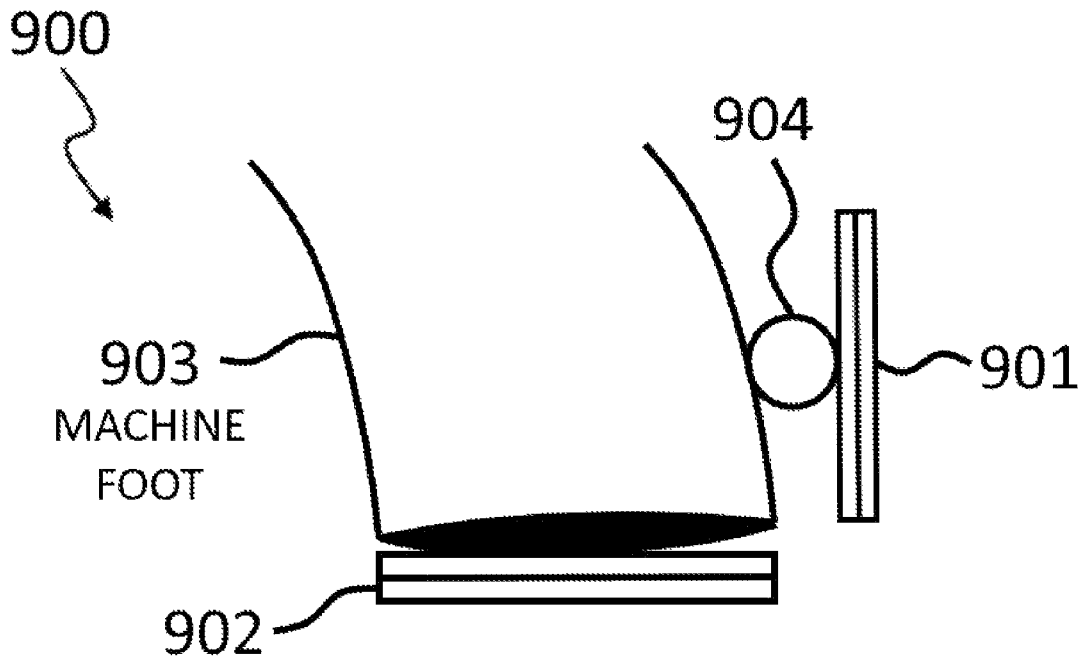
FIG. 9 depicts an example configuration of a force sensor to measure a horizontal force.

The horizontal forces may be more difficult to measure. Some shear force sensors are available. Another embodiment is to mount a force sensor vertically as shown in FIG. 9, where a 2-D force sensor 900 is depicted. In the figure, horizontal forces from machine foot 903 are sensed by a vertically mounted sensor 901. A mechanical feature 904, such as a metal or plastic sphere, rod, or bumper, may be optionally provided to couple the horizontal force between machine foot 903 and vertically-mounted sensor 901. FIG. 9 also shows optional vertical force sensor 902, so that both horizontal and vertical forces are measured. The vertical force sensor 902 and horizontal force sensor 901 may be mounted independently, or combined on a single holder, such as an L–shaped bracket.

As it may be impractical to mount eight force sensors as in the ideal case of a four footed machine, certain assumptions can be made within the processing to reduce the number of hardware sensors. One embodiment of the invention assumes that horizontal forces are negligible, and simply sets them to zero. Another embodiment assumes horizontal forces are proportional to a combination of the vertical forces. Another embodiment makes use of symmetry. One embodiment of this idea is that a force on the right side at wheel angle gammaR (i.e., on right foot 110 or 111) is equal to the force on the corresponding left foot when gammaL is equal to that gammaR. This cuts the number of required sensors down by half. Another embodiment uses both simplifications: symmetry is used, along with assumptions about horizontal forces, such that only two vertical force sensors are used. An even further simplification can result by correlating the relationships between front and rear sensors over many users, then measuring only the front or rear. If there are concerns about having a force sensor under one foot of the machine without having one in the corresponding lateral or front/back position, dummy sensing pads with the same mechanical properties, but without the sensing elements, can be provided, still at a cost and complexity savings.

Calculating the Output Variables Directly

Figure 10:
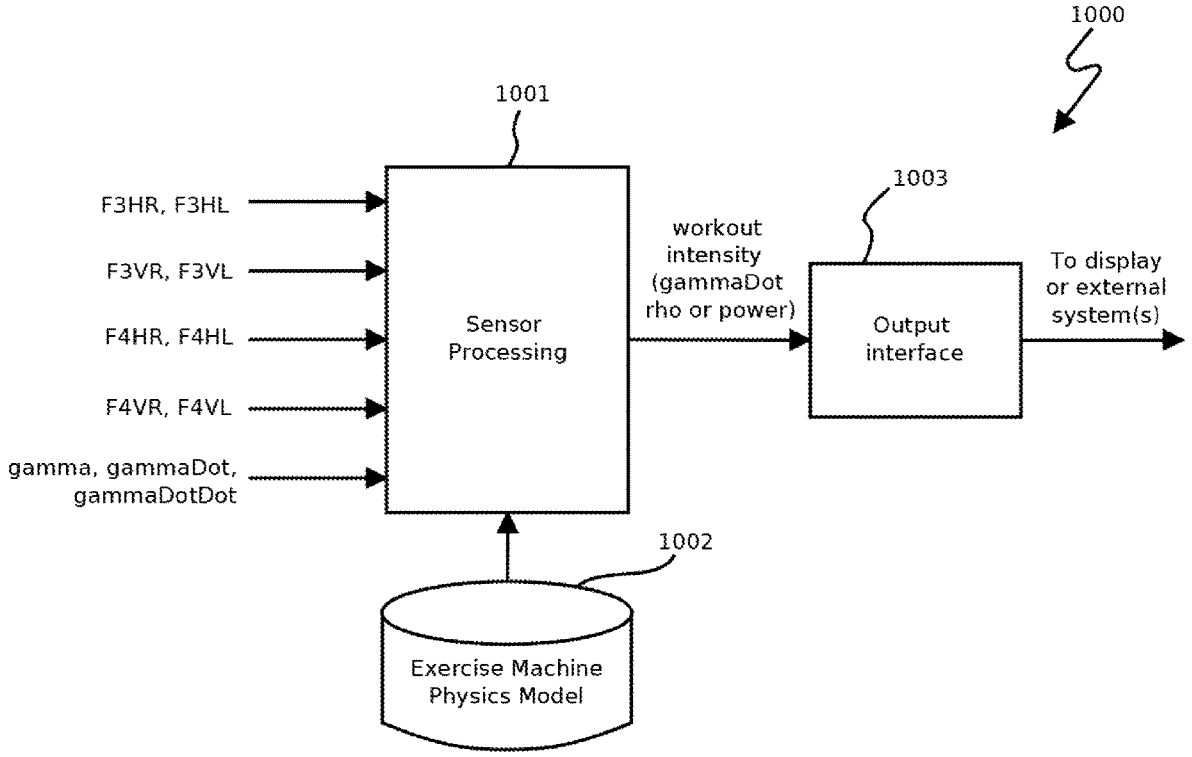
FIG. 10 depicts an example processing module to provide output calculations of angular velocity and resistance.

A goal of computation within the present invention is to output values for workout intensity, in this case rho or the power output, for example via gammaDot and rho. Any of these workout intensity quantities can be used to derive the apparent speed of the virtual object in a virtual environment, as well as the amount of force being applied using physics relationships known in the art. FIG. 10 shows a depiction of a processing module 1000 for providing a workout intensity output, for example, resistance rho, power output, or gammaDot and rho. Alternately velocity, calories burned, or other quantities of interest could alternately be produced, using the techniques and structure of the invention described herein. Various embodiments of the invention may use fewer or additional sensor inputs or derive fewer or additional outputs. Sensor processing module 1001 accepts measurable parameters from sensors collecting data from the machine, for example F3HR, F3HL, F3VR, F3VL, F4HR, F4HL, F4VR, and F4VL, optionally with more or fewer sensor inputs or functions derived from them, and outputs the needed variables as described below.

Sensor processing module 1001 accepts measurable parameters from sensors collecting data from the machine, and outputs the needed variables as described below. Exercise machine physics model 1002 has the information used by the sensor processing to compute rho, power, or whatever the outputs of interest. It is essentially a mapping to workout intensity values such as resistance, power, energy, and/or other desired output values, as a function of sensor values or quantities derived from sensor values, and optionally information about the rotational position or position within the exercise machine cycle, shown in FIG. 10 as the optional gamma, gammaDot, and gammDotDot inputs to sensor processing 1001. The essence of this model is a mathematical relationship between these inputs and outputs, and can actual equations, machine-learned mappings, curve fit parameters, lookup tables, or other representations that provide the needed outputs, as described herein or known in the art. Output interface 1003 converts or reformats the output values from Sensor processing 1001 for display to the user, or for input to other machines such as simulations, games, data sharing, social networking, etc., as described herein.

An alternate embodiment uses force sensors located on one or more of pedal 112, fixed handle 105, or linkage handle 113, and/or the corresponding left-side member of each, and thus would use inputs from the set of F1R, F1L, F5VR, F5VL, F5HR, F5HL, F2R, F2L, and perhaps indirect measurements of thetaR, and thetaL instead of the quantities shown in FIG. 10. The preferred embodiment also uses rotation angle gamma or related derivatives gammaDot and/or gammaDotDot, but if enough is known about the sensor and output interrelationships, an alternate embodiment performs Sensor Processing 1001 with only the sensor information. The underlying mechanism and methods to substitute these alternate sensor inputs for the inputs described below will be apparent to those with skill in the art.

One embodiment of the present invention includes an Exercise Machine Physics Model that uses equations derived from structural aspects of the exercise machine, including relationships of motion and/or force, i.e., kinematics and/or dynamics equations, for the machine, to directly compute the output values. This approach has the advantage of being theoretically as accurate as the equations. One disadvantage is that the dimensions of the machine need to be known, so that for each model of machine being used, such dimension measurements would be needed.

According to the above equations for the example of the elliptical machine, there are a total of 38 variables in the set of equations. When equations are included for the upper left linkage and lower left linkage, six additional equations are added, resulting in a total of 22 equations.

If one can measure the external variables and also measure the wheel gamma parameters, there would be 38−11=27 unknowns with 22 equations. The problem, then, is to remove five unknowns, add five equations, or a combination of the two.

Solving by Making Assumptions about the User:

One way to remove unknowns is to make assumptions about the user. For example, one embodiment assumes that the forces on the fixed handles (F5VR, F5VL, F5HR, and F5HL) are negligible if the user is using them only for balance. These are set to zero, or to some small value as a function of gamma that can be measured over many users in such embodiments, as will be apparent to those with skill in the art, for example, F5VR=k1 sin (gammaR+k2), etc., with ki values corresponding to four F5 variables. Another embodiment of the invention could assume that the forces on F1R and F1L are equal but opposite in direction, such that F1R=−F1L, removing one unknown.

In yet another embodiment, the approach to make assumptions about the user is to assume the user is not in contact with any external objects in the environment, The simplest version of this embodiment assumes the user's center of mass does not change, and simply sets the equations equal to zero:

$$-F1R-F1L-F5HR-F5HL+F2R\cos(\text{thetaR})+F2L\cos(\text{thetaL})=0 \quad \text{(horizontal on user,equation 21)}$$

$$F5VR+F5VL+F2R\sin(\text{thetaR})+F2L\sin(\text{thetaL})+mg=0 \quad \text{(vertical on user,equation 22)}$$

where mg is the weight of the user. Additionally assuming the person's body does not, as a whole, rotate adds three more torque equations (as viewed from side, top, and rear), using techniques as described above and apparent to those with skill in the art.

Solving by Combining Calculations Over Multiple Gamma Angles

The above embodiments compute the output variables at each point in time. Presumably, the calculated values for rho and/or gammaDot will be somewhat noisy due to sensor errors as well as characteristics of the equations and the equation solver. So it would be likely that the output values will be averaged or otherwise filtered (e.g., a low pass filter) over at least the period of one cycle.

Since the values will likely be averaged anyway, another practical approach to solving the equations is to solve them simultaneously over multiple gamma (gammaR and/or gammaL, typically differing only by a constant angle) values. An observation is that if the rho value can be assumed to be constant over one rotation of gammaR, that solving the equations simultaneously at multiple points will result in fewer unknowns, since the set of equations will be solved for only one rho value, but the other values will all be unique for the multiple points.

Another embodiment makes the additional assumption that each user force and angle is equal to the force and angle on the opposite side of the machine at an 180 degree offset of gammaR. For example, $$F1R(\text{gammaR}=20\text{ deg})=F1L(\text{gammaR}=200\text{ deg}) \quad \text{(equation 23)}$$

Thus, if each measurement point also has an associated measurement point at an 180-degree offset, there are only half as many user variables, reducing the unknowns at each point by 5. So, solving a pair of 180-degree offset points simultaneously, the derivation of the processing would start out with 27×2=54 unknowns and 22×2=44 equations, then reduce the number of unknowns by 1 (for the equal rho value) and 10 (for the symmetric user values), producing 54−11=43 unknowns with 44 equations.

One embodiment of the invention drops the symmetry constraint for one of the user variables, for example allowing F1R (angle) to be different than F1L (angle+180 degrees). An alternate embodiment of the invention accepts the over-specified equations, using an equation solver that takes into account this possibility, for example, a gradient descent procedure, resulting in some noise reduction. Such an embodiment used more than two points, for example solving for gamma values in 30-degree increments over a revolution of wheel 103.

Similarly, a more sophisticated embodiment of the invention, while making assumptions on the user, instead of assuming no instantaneous linear or angular motion, assumes a looser condition that over a period of rotation of wheel 103, there is no net displacement of the person's body. The added equations for a set of points would then integrate or sum the forces and torques from all the points and set that summation or integral to zero.

Machine Learning to Emulate the Equations and Replace Large Equation Solving

Solving the number of equations and variables as stated above could be impractical on a real-time basis for some lower-cost processors. An alternate embodiment is for the Exercise Machine Physics Model 1002 to contain data from running the solutions through many real-world or simulated examples, then to train a machine-learning module to reproduce the same outputs for the same inputs. Like the other machine-learning embodiments presented herein, this could be accomplished with a neural network, a perceptron, or other numerical techniques known in the art.

An alternate embodiment uses kinematics and dynamics equations, for example the above equations, in a simulation mode, instead of in a solving mode, by rearranging to solve for the external forces (that will ultimately be used as inputs to the system) as well as the desired outputs (e.g., rho, gammaDot) as a function of simulated user inputs to the handles and pedals of the machine. The simulation is run on many examples of real or generated user input waveforms, and the machine-learning learns the reverse mapping from the simulated sensor values to the desired outputs. The machine-learned mappings are then stored in Exercise Machine Physics Model 1002.

Using Machine Learning Instead of the Equations

Another embodiment of the invention replaces the equations with a machine-learning system that learns to predict the desired outputs (e.g., workout intensity values, rho and gammaDot) as a function of the sensor inputs, such as those shown in FIG. 10. If simulation is available, its outputs and inputs are used to train this system. Otherwise, real-world data are used to train the system. For example, many exercise machines have pre-programmed workouts that have a known time series of resistance levels. The sensor values are recorded and stored as a function of these known levels, then the machine learning system learns the mapping between sensor values and resistance level.

Figure 11:
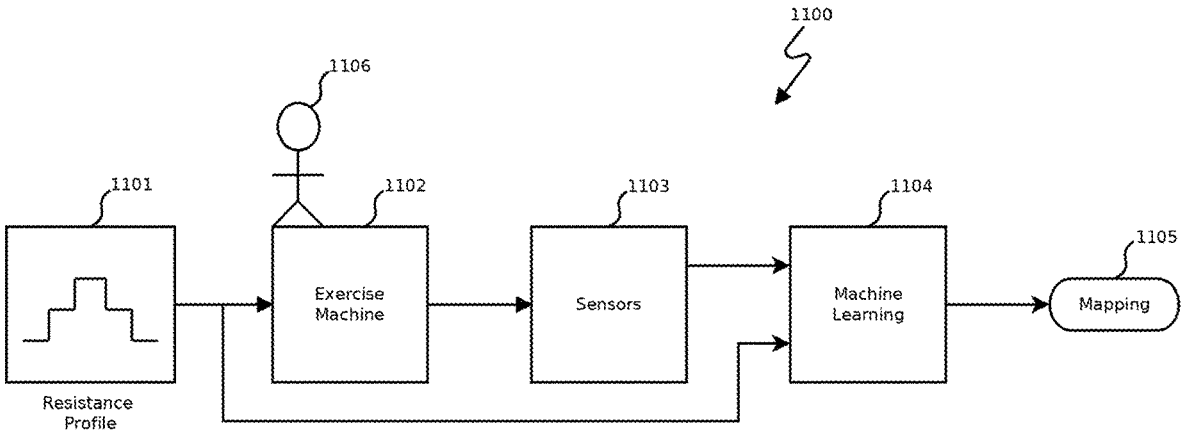
FIG. 11 depicts an example approach for calibration from sensor readings to output resistance and/or other values.

FIG. 11 illustrates a depiction of the process and/or structure 1100 for calibration of the present invention by learning to calculate resistance and/or other values based on sensor readings. A reference training profile workout 1101 is depicted, and a user 1106 performs a workout on exercise machine 1102, to which sensors 1103 are coupled, for example by the techniques described elsewhere in this Specification. The outputs of sensors 1103 are then synchronized, either in real time, or by storage and combining, with the reference values in resistance profile 1101. Resistance profile 1101 thus acts as "ground truth" reference for training to learn a mapping 1105 between sensor values and resistance level. Machine learning 1104 can be a neural network, perceptron, least-squares optimization, curve fitter, or other technology known in the art for creating a mapping between input and output variables. Alternately machine learning 1104 here, as well as in other examples of machine learning described elsewhere herein, could be a manual or semi-automated process involving inspection of the data to create a function that approximates the desired outputs, based on the inputs.

Something as simple as an empirically derived weighted average of sensor values could be used. As will be apparent to those of skill in the art, machine learning 1104 may also involve preprocessing of the sensor data by creating features values based on algorithms applied to the sensor values, their integral, low-pass or high-pass filtering of the values, taking max and/or min of the values, etc. The mapping 1105 is then used for producing workout intensity outputs, for example in Exercise Machine Physics Model 1002.

Instead of a pre-stored training profile 1101, an alternate embodiment of the invention asks the user to manually set different resistance levels, such that a similar process is followed as described above. The invention may optionally also request different speeds of action from the user in this process.

Figure 12:
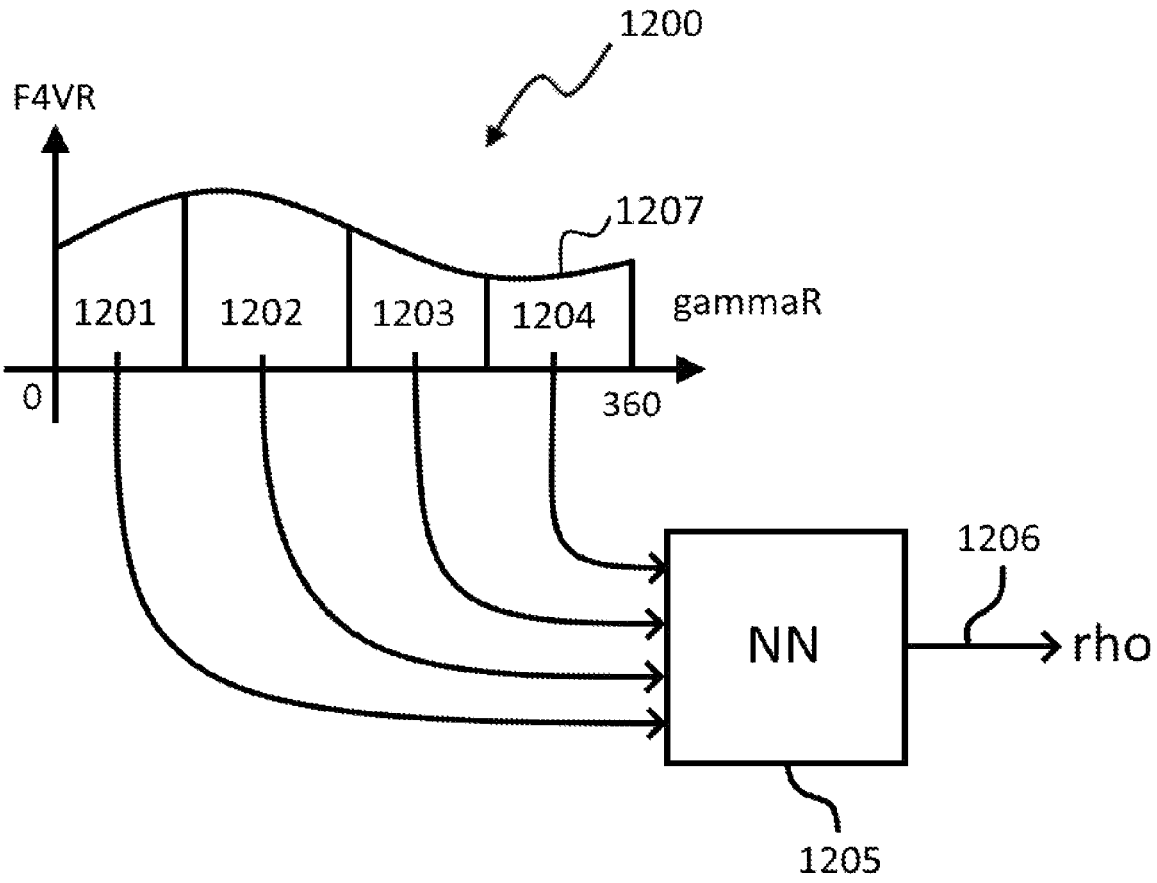
FIG. 12 depicts the operation of an example module to infer resistance from a data integral.

Rather than a point-by-point training to compute the outputs at individual data measurements, if the gamma value is known, the machine-learning system is in an embodiment of the invention, trained over multiple points in the rotation of wheel 103. FIG. 12 depicts one embodiment of an example of a module 1200 to infer rho from an integral under curve 1207. One or more of the sensor inputs, for example F4VR as shown in FIG. 12, has samples taken or integrals taken over periods of time, resulting in integral values 1201, 1202, 1203, and 1204. These values are input to a machine-learning system 1205, e.g, a neural network, which is trained to produce a desired output 1206, for example an estimate of rho. FIG. 12 shows the integral being taken over an entire 360 degree rotation of wheel 103, but other intervals could be used equivalently.

A preferred embodiment of the invention uses values such as 1201, 1202, 1203 and 1204 from more than one variable, for example, from all sensor values being used, such as F4VL, F4HR, F3VL, F3VR, F3HR, F3HL.

In addition to feeding raw data of sensor values straight into the machine-learning algorithm, a preferred embodiment of the invention creates additional features that have been observed to correlate with the desired outputs. Although a machine-learning system may be able to discover these relationships on its own with enough training data, providing such hints may allow for smaller training datasets or training time. For example, as resistance level increases, the variability of gammaDot has frequently been observed. Therefore, the value of gammaDot, or the angular acceleration value gammaDotDot could be an input, or alternately the integral of the absolute value of gammaDotDot could be provided as an input, or alternately the product between gammaDot and gammaDotDot or its integral could be provided as an input, or still alternately, the range from max to min of the value of gammaDot or gammaDotDot over the time period in question could be an input. Similarly, other statistics about the deviation of gammaDot from its mean value could be used as inputs.

If sensors are being used to measure or derive other quantities, such as gamma, gammaDot, gammaDotDot, alpha, alphaDot, alphaDotDot, beta, betaDot, or betaDotDot, these sensor values may optionally be entered as additional inputs to the machine learning feature vector. And in addition to the actually measured values, integrating them or solving for other of the quantities via the known trigonometric relationships of the machine, are additionally optionally used as additional inputs to the machine learning.

The machine learning inputs described in the previous several paragraphs can be used in the other embodiments of the present invention that use machine learning feature vectors, by adding the above values as additional feature vector values to whatever feature vector values are described in the relevant section of this specification.

Using Machine Learning Based on the Equations

An alternate embodiment of the invention makes use of the form of the equations, rather than the exact equations, to guide a machine-learning process. This could be thought of as a compromise between exact solution of the equations on one hand, and completely replacing the equations with a black-box machine learning process on the other hand. Such a system may need to be trained per user or per machine model, but it avoids the need for precise measurements of machine geometry and avoids the need to solve large systems of equations.

Figure 13:
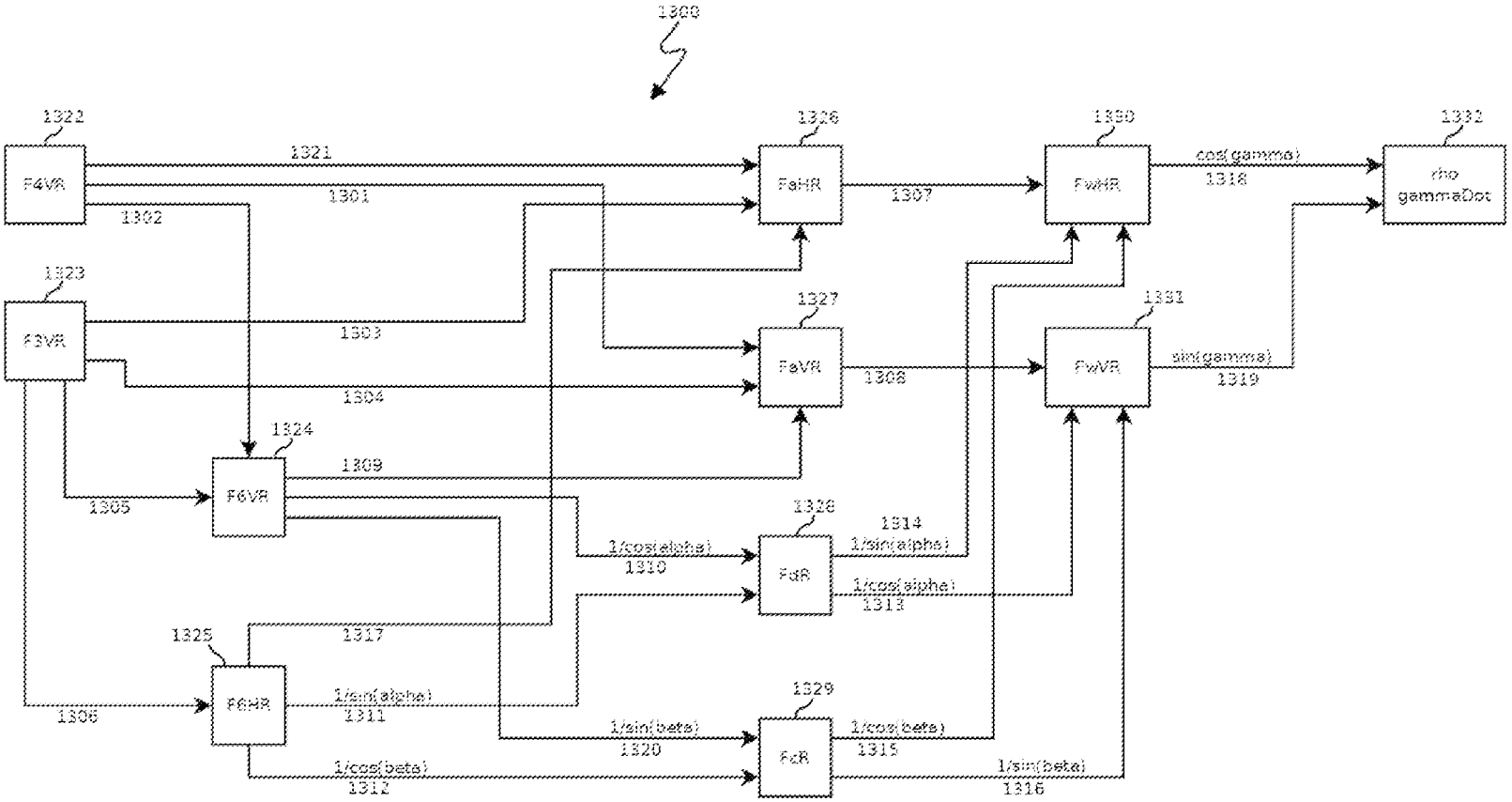
FIG. 13 depicts an example influence diagram used to generate a model for the physics of an exercise machine.

One way to envision this embodiment is as an influence diagram, as shown in FIG. 13. Influence diagram 1300 is created from the set of equations for the right side of the machine, assuming that the sensor inputs are the vertical floor forces F4VR and F3VR, and the output 1332 is rho gammaDot, or equivalently, power output. Many alternate influence diagrams can be created in various embodiments, depending on the designer's preference. The diagram could be extended to include equations for the left side of the machine, or any other combination of sensor inputs. The influence links 1301 through 1321 correspond to equations that relate the various physical quantities describing exercise machine motion. If factors of trigonometric or other functions are involved, they are indicated on the example influence labels of FIG. 13. The example quantity blocks F4VR 1322, F3VR 1323, F6VR 1324, F6HR 1325, FaHR 1326, FaVR 1327, FdR 1328, FcR 1329, FwHR 1330, FwVR 1331, and rho gammaDot 1332 correspond to the variables in the force diagram, and may correspond to quantities such as forces, resistances, power, etc.

Figure 14:
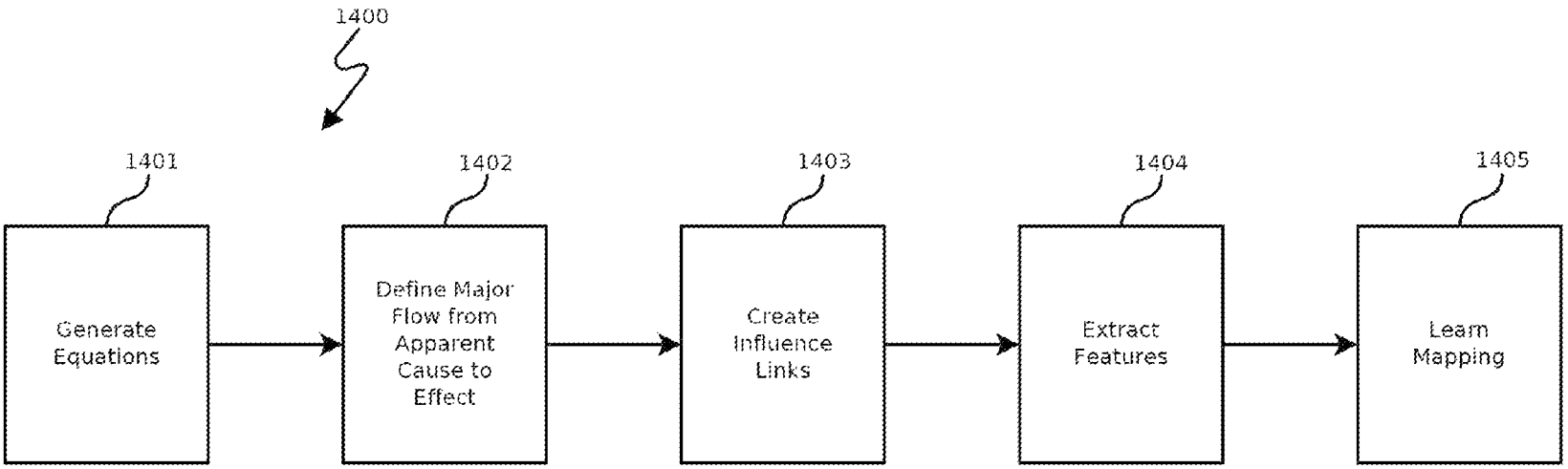
FIG. 14 depicts an example method for implementing an influence diagram.

FIG. 14 depicts a preferred method 1400, which is one way to implement an influence diagram according to the present invention. This example method uses engineering insights to identify a plausible connection between the inputs and outputs of the physics involved with the machine, from sensed quantities, resulting in outputs that correspond to what is needed to interact with the simulation, game, or other use of the exercise data. For example, influence diagram 1300, with influences 1301 through 1321, was created as follows:

First, the equations are produced, for example the equations 1 through 16 above. This is represented as the generate equations module 1401.

Based on engineering insights, assert that the effects on rho and gammaDot are largely due to the forces on wheel 103. And that these forces are largely related to the sensor inputs due to the forces on the wheel axle 109 and pivot 106. This is represented by module 1402, define major flow from apparent cause to effect. For example, the following stages are evident:

Vertical floor forces→axle and pivot forces→wheel forces→rho and gammaDot

Next, equations are found that connect these to each other, essentially finding differential relationships between the earlier and later parts of each influence. These are represented in FIG. 13 as influences 1301 through 1321, and the process is represented as Create influence links 1403. For example, Influences 1311 and 1312 are based on Equation 1. Influences 1310 and 1321 are based on Equation 2. Influences 1314 and 1315 are based on Equation 4. Influence 1313 and 1316 are based on Equation 5. Influence 1307 is based on Equation 7, Influence 1308 is based on Equation 8. Influences 1318 and 1319 are based on Equation 9. Influence 1317 is based on Equation 12. Influences 1301, 1302, 1304, 1305, and 1309 are based on Equation 13. Influences 1321, 1303, and 1306 are based on equation 14. Any influences that appear to be insignificant with respect to other parts of the equation in which they are found may optionally be removed. For example, equation 2 relates force FdR to F6HR. 3.3 via a sin (alphaR) relationship, and since alphaR is typically small, influences 1311 and 1320 might be candidates for deletion in some embodiments of the present invention. In one embodiment of the process, even if the sine is in the denominator when the equation is solved for the effect of the influence, which would imply a large effect, the equation may be dropped if there are other influences in the equation that do not use the sine, suggesting the influence of the pair of quantities in question is relatively weak.

Next, continuing within the example process represented by Create influence links 1403, the permutations of all the remaining influences may be assembled that traverse from the sensors to the desired calculation outputs, preferably including multiplicative factors such as trigonometric functions such as sines and cosines of angles in the relevant equations. Optionally, the sign of the influence is also included, if the process that uses the influences later is enhanced. As with the multiplicative factors, the signs are found by rewriting the equation in question for the effect of the influence in terms of the cause.

Optionally, the torque equations are rewritten to not be with respect to with any of the points, which eliminates those points from the equations. This will add some extra terms to the equations. For example, if Equation 14 were written with respect to a point somewhat to the left of the front foot, there would be a torque effect from F4VR. This introduces a new influence between F4VR and FaHR, shown as influence 1321.

Finally, assemble the set of influence relations between sensors and outputs as a feature vector for a machine learning module. This is represented by extract features module 1404.

Train the machine-learning module with known mappings between sensors and outputs, for example, using the pre-programmed workout profiles described above. This is represented in module 1405, learn mapping.

In FIG. 13, the equation number is shown in parentheses, and the label is placed near the arrow between the influence cause and effect. In the example of FIG. 13, the feature values for input to the machine learning system may include, among others:

F4VR sin (gammaR) from influences 1301, 1308, and 1319 and influences 1302, 1309, 1308, 1319

F4VR cos (gammaR) from influences 1321, 1307, and 1318

F3VR sin (gammaR) from influences 1304, 1308, 1319

F3VR cos (gammaR) from influences 1303, 1307, 1318 and influences 1306, 1317, 1307, 1318 and influences 1306, 1312, 1315, 1318

F3VR sin (gammaR)/cos/^2 (alphaR) from influences 1305, 1310, 1313, 1319 F4VR sin (gammaR)/cos/^2 (alphaR) from influences 1302, 1310, 1313, 1319

As elsewhere herein, the machine-learning that maps from the values of these feature vectors to the desired outputs could be a perceptron, one of several varieties of neural network, such as a feedforward neural network, or other machine-learning approach as will be apparent to those of skill in the art.

Embodiments of the invention utilize these features in several ways. One embodiment adds an additional input to the feature vector that is the gammaR value. This allows the machine learning to learn the mappings as a function of the gamma values. A preferred embodiment divides the rotation of wheel 103 into sections such as those in FIG. 12, averaging, integrating, or otherwise combining each of the feature values over each section. Then, all the averaged values across all the sections are combined into one large feature vector. For example, if the space of gammaR is divided into four sections as in FIG. 12, and there are 7 features being accumulated per the example listing above, the total number of inputs to the machine learning system are 4×7=28 inputs. This embodiment of the invention thus learns the mapping to the desired outputs from the set of all data accumulated per revolution of wheel 103. Data could be accumulated over any desired amount of rotation of gamma, but one revolution is a convenient amount for describing the operation of the present invention.

Inferring Parameters Based on Inertial Effects

In an alternate embodiment of the present invention, when using the machine, the user can move the mechanism until at any rate, but preferably at a high revolution rate, then stop providing any input force so the machine can naturally slow down based on the machine's resistance level. By measuring the angular deceleration, for example, gammaDotDot in the above equations, during this period, this embodiment infers some of the machine properties. For example, the quantities of resistance rho and moment of inertia/may be revealed, according to the above equations. In a preferred embodiment, the value of/is known, so this process reveals the value of rho. Optionally, given a known rho during a calibration phase, the value of/could be computed, using analogous techniques that will be apparent to those of skill in the art.

Such a calibration process may be performed over different resistance levels to build a resistance or angular deceleration profile for the machine. This angular deceleration profile may then be used to infer machine resistance during natural angular deceleration periods during individual revolutions, using equations such as the above example equations, or similar relations that will be apparent to those of skill in the art.

Commanding Resistance Changes

As described above, an alternate embodiment of the present invention controls rho as a function of simulated environmental factors such as incline by issuing commands to the user to change the resistance manually, if there is no automated means for doing so. This embodiment would either indicate to increase or decrease the resistance, and/or to set it at a particular known value.

The computations described above are then optionally used to confirm that the changes were made.

This would possibly be helpful if the sensors and/or equations are not of very high accuracy, so that in an alternate embodiment of the present invention, a qualitative change or approximate change in the resistance would suffice to confirm the action, instead of requiring an exact measurement of the requested resistance value.

The Weight of the User and Invention Features Related to it

Given the weight of the user, this can be used in an embodiment of the invention to calibrate the force sensors. This allows proportional force sensors, which can be less expensive than highly accurate sensors such as load cells.

When force data are collected during training or calibration of the system, the average or quiescent values of the force sensors are stored. Then, when the system is used at another time, the force readings from the sensors are scaled so as to be equal to the calibration case.

When the user gets onto the machine, if there are a known number of feet or contacts of the machine with the floor, it can be inferred that the sum of changes of force adds up to the user's weight. If the weight of the machine is also known, extrapolation can be used to infer the user's weight from the change in force readings occurring when the user mounts the machine.

During slow periods of action on the machine, the maximum force on each pedal will be about equal to the user's weight. An approximation of the horizontal displacements of the right and rear foot positions (see FIG. 3) will indicate the distribution of the user's weight on the right and left sensor points. So the peak in force on one side should correspond to the user's weight, multiplied according to this left/right distribution of weight, as will be apparent to those skilled in the art.

Using the Outputs of the Algorithms to Interface with External Systems.

The output of the present invention One embodiment of the invention causes a virtual object, for example, a bike, person, boat, etc. to behave in a simulated environment as a result of the actions of the user on the exercise machine. For example, one embodiment includes a simulated road, path, or trail in a simulated environment, with pre-stored scenery objects and known plot of the trail, including its elevation at various points. There are graphics techniques known in the art for displaying a view of the environment, given the position of the virtual object on the simulated trail. Alternately, instead of a 3-D depiction, other embodiments of the invention include a 2-D graph of terrain, or a textual output of distance traveled, elevation gain, slope of inclination, etc.

The preferred embodiment of the present invention updates the values of several quantities based on the simulation or game environment as well as on quantities derived from sensor readings from the machine. For example, these quantities and their interrelationships may include:

$$\text{powerOutput}=fp(\text{gammaDot},rho) \quad \text{(equation 24)}$$

One simple example in one embodiment is $$\text{powerOutput}=kp\ \text{gammaDot}rho, \quad \text{(equation 25)}$$

where kp is calculated to produce the correct dimensions of power (for example, in Watts), based on the wheel rotation speed and the resistance.

For an embodiment in which the virtual environment is an object moving through space, the simulated drag due to resistance from air is based on assuming that the system's virtual object is behaving like a real vehicle, bicycle, other transportation contrivance, or runner. In this specification, we refer to the entity being simulated as the "virtual object", which herein may also refer to a runner's body, or whatever entity is being simulated to move through space. From the assumed virtual object, the drag is computed by methods apparent to those of skill in the art. In addition to the physical realities of simulation, such as the physical version of the virtual object physical parameters such as dimensions, frontal area, mass, friction, etc., there may be additional effects to model neurological effects, psychological effects, or other types of effects. For example, if traveling at higher speeds, there may be balance instabilities introduced by rapid pedaling that would result in less efficient power generation, so the function fw in this example embodiment would slightly increase the drag effect with rising gammaDot, as shown in the equation below.

$$\text{drag}=fw(\text{virtualSpeed},\text{gammaDot}) \quad \text{(equation 26)}$$

A simple embodiment of a drag equation in the present invention is $$\text{drag}=ks\ \text{virtualSpeed}\ \wedge 2+kb\ \text{gammaDot} \quad \text{(equation 27)}$$

An alternate embodiment additionally includes the effects of wind blowing may include for example, the corresponding variable windSpeed, as shown in this equation:

$$\text{drag}=fw(\text{virtualSpeed},\text{windSpeed},\text{gammaDot}) \quad \text{(equation 28)}$$

Modifications to the other equations to include windSpeed will be apparent to those of skill in the art.

The effects of gravity due to the incline of hills are represented in a preferred embodiment of the invention as the function fg:

$$\text{force}due\ \text{to gravity}=fg(\text{inclineAngle}) \quad \text{(equation 29)}$$

A simple embodiment of this equation is $$fg(\text{inclineAngle})=\text{mass sin (inclineAngle)}, \quad \text{(equation 30)}$$

where mass is estimated for the user plus the virtual object, if any.

Thus, given an incline angle, represented for example by a variable named inclineAngle, and inferring gammaDot and rho according to the techniques described elsewhere above, a preferred embodiment of the invention will solve the following equation for virtualSpeed:

$$\text{powerOutput}=fg(\text{inclineAngle})+fw(\text{virtualSpeed},\text{gammaDot}) \quad \text{(equation 31) or}$$

$$fp(\text{gammaDot},rho)=fg(\text{inclineAngle})+fw(\text{virtualSpeed},\text{gammaDot}) \quad \text{(equation 32)}$$

For example, these emulations may be implemented in embodiments of virtual object conversion 1504.

In the present descriptions, virtualSpeed is used to refer to the simulated velocity of the virtual object. Although the equations above focus on forces and power output, the velocity is calculated in the preferred embodiments using standard physics models that will be apparent to those of skill in the art, and it will be apparent that conversions between using power, energy, time, and velocity are possible within the scope of the invention.

One embodiment of the present invention accomplishes this by determining from measurements, simulations, or published results, the speed of locomotion as a function of power output of the user, and optionally also the cadence, with a function such as the following. (Cadence can be converted back and forth from the exercise machine angular rate and gammaDot in straightforward manner, as will be apparent to those of skill in the art.)

$$\text{virtualSpeed}=fe(\text{powerOutput},\text{gammaDot}) \quad \text{(equation 35)}$$

For example, in cycling, there is a fairly level relationship between power output by the user and its conversion into cycling speed, due to gear shifts, the efficiency of the chain drive, etc. However, for running, there may be a more sensitive function of the cadence, or frequency of motion. For example, producing very large bursts of power in very slow, giant bounding jumps does not typically result in efficient running. So in a preferred embodiment, the virtual speed function will represent these physiological and mechanical mappings. There are many available models for calculating the speed of a vehicle, person, or other object on the basis of power output and other characteristics of the user and machine, therefore providing alternate embodiments for the calculation of virtualSpeed above will be apparent to those of skill in the art.

For alternate embodiments not emulating physical objects moving through space according to standard laws of physics, an unlimited variety of rules for computing the speed of the action in the virtual environment are possible.

The Gear Ratio Quantity

A quantity herein called gearRatio is also preferably defined in embodiments simulating the travel of physical objects, in line with the discussion above under " . . . substituting for the control of resistance . . . ", This quantity determines the amount of distance corresponding to each cyclical motion of the exercise machine:

$$\text{gearRatio}=\text{virtualSpeed}/(\text{gammaDot}r) \quad \text{(equation 33)}$$

which for example, may result in $$fp(\text{gammaDot},rho)=fg(\text{inclineAngle})+fw(\text{gearRatio gammaDot}r,\text{gammaDot}) \quad \text{(equation 34)}$$

This equation is solved for gearRatio in a preferred embodiment of the present invention.

It can be seen from the above equation, that changes to gearRatio can be effected both by changes to rho, which is controlled by the user, and/or by inclineAngle, which is controlled by the simulated environment.

In a preferred embodiment, gearRatio is scaled to a human-friendly value, such as by having the maximum gearRatio value be on a scale with a maximum of about 5 to 10.

A preferred embodiment includes a graphical, auditory, or tactile (e.g., vibration) feedback communicating the effects of gearRatio. For example, if the virtual object is traveling along a simulated straight path, there will be a certain virtualSpeed computed from gammaDot and rho. If the user wishes to travel faster and would rather work harder than simply pedal faster, they can manually increase rho with the controls on the machine to, in effect, increase the gearRatio.

Similarly, when a hill is encountered, an embodiment of the present invention will compute a new gearRatio, which will result in a lower ratio, and as in the real world, the virtual object will now be traveling less distance per revolution.

In an optional embodiment, an auditory whir, tone, or other sound effect that may imply rotation could increase in frequency, amplitude, pulse rate, etc. to show this increase, a dial on a graphical display could show a higher gear ratio, a voice could indicate the gear ratio. Alternately, the system could create audible and/or tactile clicks, ker-chunks, or shifting sounds to show the gear shifting happening, to make the experience more realistic. A gear shift graphic, for example a depiction of a gear shift lever or knob, could also or alternately be shown. Providing these signals on the basis of speed is used in another embodiment of the invention, and indirectly communicates gear ratio to the user.

Due to uncertainties in sensors and equations, the gear ratio will be filtered in a preferred embodiment of the invention, for example with a low-pass filter, to avoid confusing rapid changes to the displayed gearRatio.

Interfacing to Game or Simulation Systems

One embodiment of the present invention is as a standalone game or simulation system. This embodiment includes the sensors and computation described above, plus simulation or gaming software that determines where in the simulated environment the virtual object (and hence, user) is, what the inclines, slopes, headwinds, etc. are being faced, and what happens in the environment as a function of the user's force, power, and/or speed, etc. Graphical, textual, audio, or other outputs of the simulation or game state are provided, as will be apparent to those of skill in the art.\

For an alternate embodiment of the present invention in which the virtual object does not correspond to a realistic physical object, other varieties of mapping the quantities measured by the invention to behavior in the virtual environment are possible, such as skill level, accuracy, etc. as described elsewhere herein, will be apparent from the context of the virtual environment.

A preferred embodiment of the present invention interfaces to an existing simulation or game system, such as one of several currently available online. In this embodiment, the existing simulation system may provide a simulation of the environment, and an output to a display the state of the system.

Embodiments of the present invention to do this may interact with various of the quantities described herein. For example, one embodiment provides the power output to the simulation or game, and the simulation or game provides all the calculations of speed and/or the other variables on the basis of power output. In another embodiment, the game keeps track of the location of the virtual object, and provides the incline of the path to the invention, which in turn calculates the virtual velocity as a function of the incline, power output, and optionally other variables as described above. Any permutation is possible, as to which calculations are performed, and whether they take place in the external game or in the internal processing of the module interfacing to the sensors. This is determined by the sophistication, design, and interface provided by the existing simulation or game.

In such embodiments, there are likely no provisions to display some of the specific features of the present invention, particularly the state of the virtual "gear shift" or the feedback about it. Displaying such features of the invention can be accomplished in embodiments of the invention through one or more of the following techniques:

Provide a popup window that appears along with the display of the existing simulation system, showing the gear shift, etc.

Use a separate device than that running the simulation system, such as an additional computer, cell-phone, watch, etc., to provide a secondary display which shows the gear shift, etc.

Provide additional hardware to serve as a standalone display or indicator for the gear shift, etc.

Provide a sound or vibration signals as input to the Operating System of the host device running the simulation that has the sound effects of gear shifts, etc., such as "klunk" sounds, a whirring sound representing the speed of part of the "transmission" of the "gear shift", the overall speed, etc.

Provide independent sound or vibration signals from hardware associated with the present invention's sensors, such as speakers, headphones, vibration actuators, etc., to provide the sound effects indicating the gear shifting, etc.

Interfacing to Existing Exercise Simulation/Gaming/Other Software with Standardized Interfaces.

Various protocols exist for existing types of exercise machines to interface with external systems, such as existing virtual environments, including for example simulation, classes, and gaming systems, or simply to record, view, or share workout data. These exist under protocols such as Bluetooth and ANT+, as well as various data file formats. Embodiments of the present invention interface to these or similar existing or future protocols, whereas other embodiments interface to custom protocols appropriate for the application.

A preferred embodiment of the present invention interfaces to various virtual environments by emulating exercise machines and/or by emulating virtual objects and/or by performing conversions between data relevant to these exercise machines and virtual objects, depending on the external system with which the invention is interfaced. Many combinations of exercise machines with virtual environments are possible. For example, the user may be doing a workout on a treadmill, elliptical, stair-stepper, or exercise bike, and being interacting in a virtual environment on a bicycle, boat, or with running on foot. As an example, to interface the present invention to a virtual cycling environment, one embodiment converts outputs generated from the exercise machine, for example, an elliptical machine, to appear as if from a smart bicycle trainer. In another embodiment, for example, a virtual elliptical class, the existing elliptical would simply be emulating an instrumented elliptical, a more straightforward emulation.

In another embodiment of the present invention, if the exercise machine is used to simulate a physical entity in a simulation or game, in other words, to emulate a specified category of virtual object, the outputs of the calculations are configured to represent the specified virtual object, such as a bicycle, and its motion in the virtual environment, such as on a road or trail, even if the exercise machine is not similar or identical in structure to the virtual object's structure. This is done by converting the outputs into a form more representative of parameters relevant to the virtual object.

Figure 15:
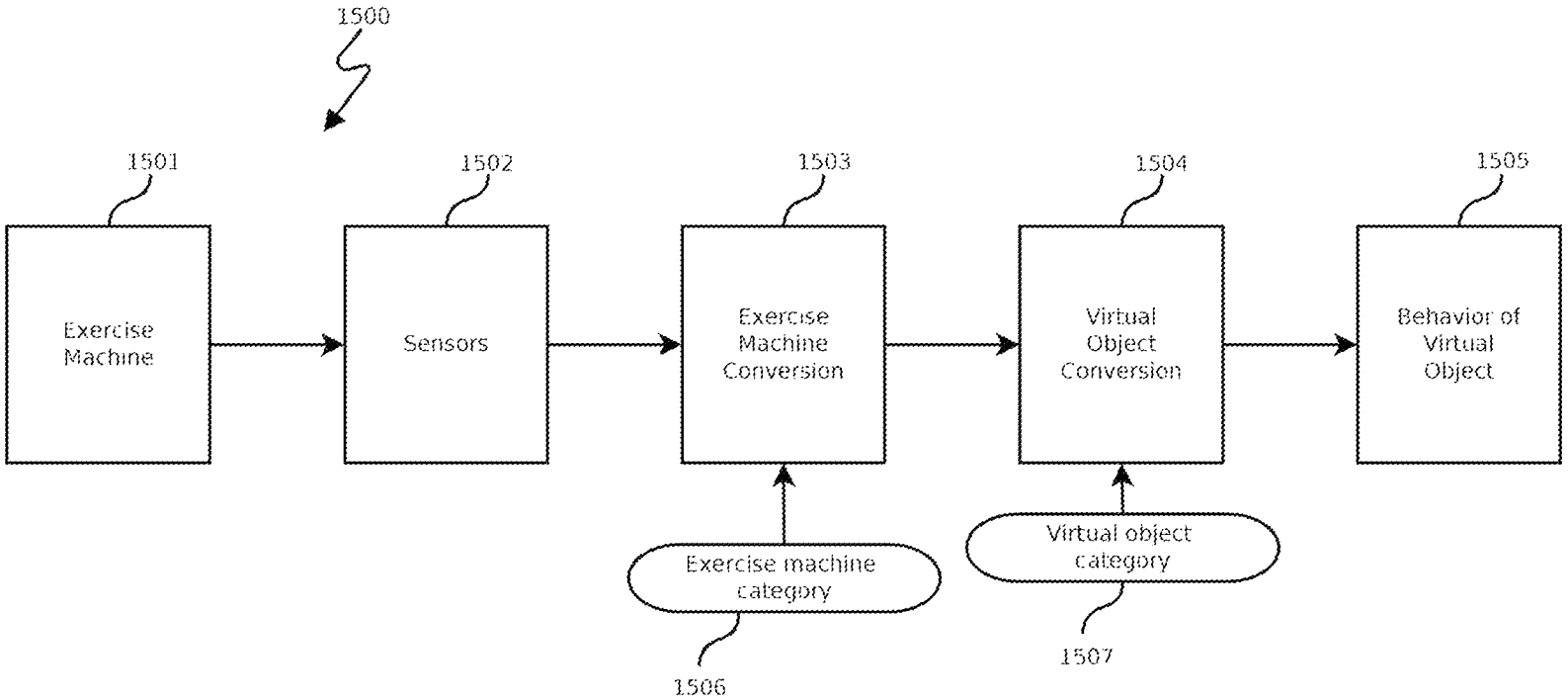
FIG. 15 depicts example conversions of data between exercise machine types and between virtual object types.

FIG. 15 depicts and example exercise machine and virtual object conversion 1500, depicting some of the conversions and emulations that may be embodied in the present invention. Exercise machine 1501 is operated by the user, with sensors 1502 coupled to it as described elsewhere herein. The outputs of sensors 1502 go to an optional exercise machine conversion 1503, for example, a conversion from the physics of an elliptical into the physics of a smart bicycle trainer. The type of exercise machine into which exercise machine conversion 1503 converts is controlled by its exercise machine category input 1506, which may come, for example, from a user input on a user interface of the invention, or alternately, from a machine profile or other data structure associated with a virtual environment expecting inputs from a particular category of exercise machine. The conversion performed by exercise machine conversion 1503 may involve a wide variety of exercise machine motion parameters, such as cadence, velocity, wheel speed, exercise machine angular rate, RPM, and power output. In this conversion, some exercise machine motion parameters such as power output may be very similar to the exercise machine 1501 motion parameters, but others such as RPM, and wheel speed may be different, due to the differing geometry and/or usage of the two types of machines. The outputs of exercise machine conversion 1503 are output to the optional virtual object conversion 1504, which is based on a model of how a virtual object operates in the virtual environment as a function of the outputs of the exercise machine conversion 1503. The conversion performed by virtual object conversion 1504 may involve a wide variety of virtual object behavior parameters, such as motion parameters, for example virtual speed, power output, and cadence, as well as other behavioral parameters if in the embodiment, virtual object is not representing the motion of a physical object. For example, using algorithms described previously, 1504 may encapsulate the equations for road speed of a bicycle as a function of the power output of the exercise machine, the slope of the road at the virtual location, and the wind resistance as a function of the virtual speed. Behavior of virtual object 1505 is produced by the virtual object conversion 1505, and can include the above enumerated virtual object behavior parameters and/or other relevant parameters of the virtual object's behavior. The type of virtual object that virtual object conversion 1504 converts to is based on Virtual object category input 1507, which can be for example, from a user input on an interface of the invention, or from profile information or other data structure associated with the virtual environment.

As will be apparent to those of skill in the art, the various algorithms described above may be implemented in various of the blocks of FIG. 15, according to the needs of the system to which the invention is interfaced.

Exercise Machine Conversion

Figure 16:
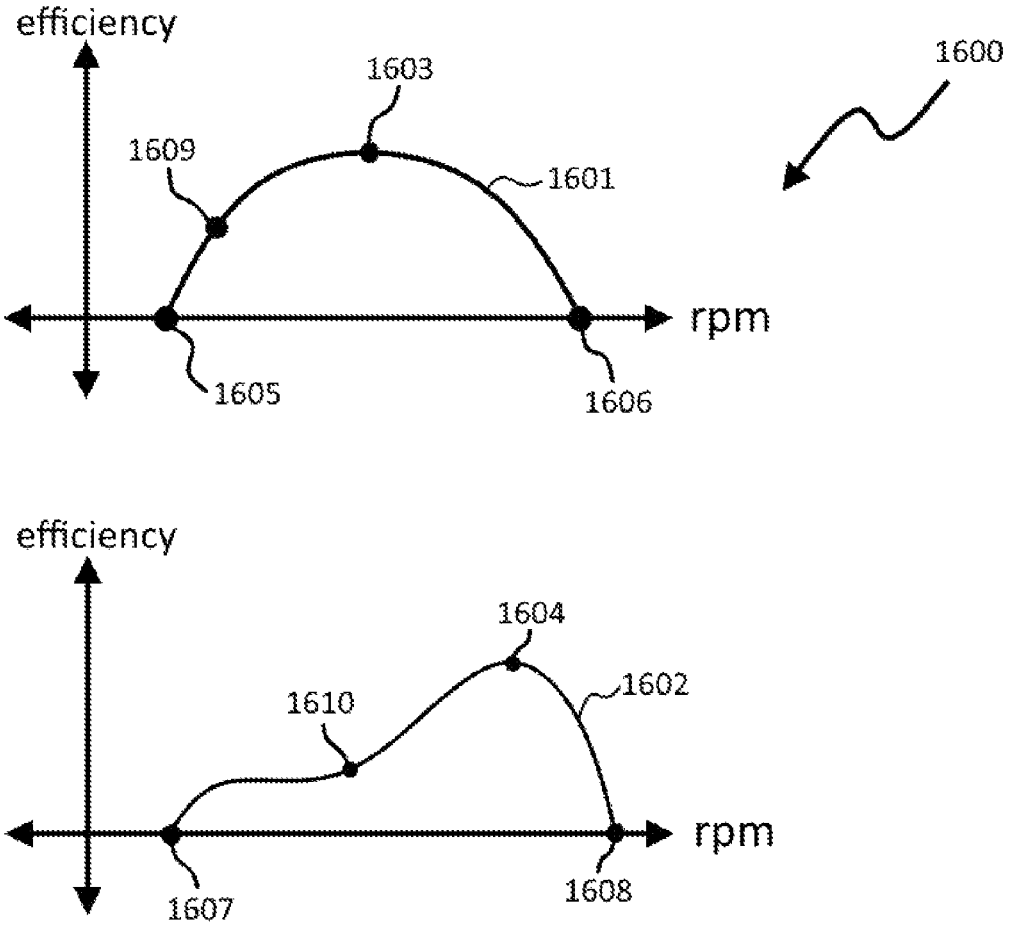
FIG. 16 depicts an example conversion of an exercise machine parameter from one exercise machine type to another exercise machine type.

Exercise machine conversion 1503 implements a mathematical mapping between exercise machine motion parameters of one exercise machine category to exercise machine motion parameters corresponding to another exercise machine category. FIG. 16 depicts an example of conversion technique 1600 of an exercise machine motion parameter according to an example of how exercise machine conversion 1503 may operate. The motion parameter for example may be RPM (revolutions per minute), or cycles per minute of the exercise machine mechanism. For example, the RPM range of an elliptical machine may typically be lower than the RPM range of a cycling exercise machine, so for realistic simulations, the actual RPM of the elliptical is preferably converted to a reasonable cycling RPM as shown in FIG. 16. One example conversion is to use efficiency functions of the exercise machines, which represent the exact or approximate energy conversion efficiency for a user to provide mechanical energy as a function of the cycle or repetition rate, i.e., cadence. For example, elliptical efficiency function 1601 has an elliptical minimum likely RPM value 1605, an elliptical peak efficiency RPM value 1603, and an elliptical maximum likely RPM value 1606, whereas cycling efficiency function 1602 has a minimum likely RPM value 1607, a peak cycling efficiency RPM value 1604, and a maximum cycling likely RPM value 1608. In this example, using function mapping techniques known in the art, a given elliptical RPM value 1609 is converted to a reasonable cycling RPM value 1610, for example, by selecting a value providing an equal percentage area under the curve up to the RPM values 1609 and 1610. Other simpler or more complex conversions may be implemented in other embodiments of the present invention. Similarly, conversions between other motion parameters are implemented in other embodiments of the invention.

In another example, consider that the typical stride frequency or cadence in running is considerably higher than that of an elliptical. So if an elliptical is used with the present invention to emulate a treadmill, a different, but analogous conversion of cadence for equivalence is used in a preferred embodiment. A simpler example of the implementation of this conversion in an alternate embodiment that includes multiplying the cadence implied by gammaDot by a factor, for example, a number near 2.0, based on the average cyclical rates of running and elliptical exercise. The chosen factor is obtained in the preferred embodiment, for example, by observing large numbers of people performing each exercise and measuring statistics of each frequency. Power outputs may also be converted to account for differences in conversion from user power output to exercise machine motion, for example, an equal quantity of the user's energy expended in running on a treadmill may produce less mechanical forward motion than it would in pedaling of a bicycle. The measured power output can be converted according to one embodiment of the present invention using known biomechanical constants and functions available in the art.

Such conversions can alternately be accommodated by setting of the gearRatio, or by other means that will be apparent to those with skill in the art.

Virtual Object Conversion

Virtual object conversion 1504 implements a mathematical mapping between virtual object behavior parameters of one virtual object category to virtual object behavior parameters corresponding to another virtual category. For example, if the invention has been configured to output parameters corresponding to a bicycle, but the interfaced game or simulation is designed to simulate the motion of a skier (i.e., the virtual object is a skier), then virtual object conversion 1504 converts the virtual object behavior parameters from virtual bicycle behavior parameters into virtual skier behavior parameters, using equations and techniques similar to the above examples.

The conversion in virtual object conversion 1504 is preferably based on mathematical mappings between physics, biological, anatomical, and/or physiological quantities involved with the virtual objects and with the user. For example, a mapping similar to conversion 1600 may be adapted for use in converting between virtual objects, for example, between the pedaling rate of a bicycle and the ski cadence of a skier. The process is analogous to that shown in FIG. 16, but applied to virtual objects being simulated, instead of to varieties of exercise machines. Using other equations, for example the velocity calculations of Equation 35, it will be apparent to those of skill in the art that a conversion between, for example bicycle speed and skiing speed, is achieved in an embodiment of the present invention, for example, by algebraic solving two instances of Equation 35 for the two virtual object types, using techniques known in the art.

Likewise, alternate embodiments implement conversions between parameters related to the motion of physical objects, converting them to or from behavioral parameters of types of virtual objects not modeled as physical objects in motion, such as targeting, building structures, skill level, or accuracy, or the other types of virtual environmental behaviors and controlling factors described herein.

Embodiments of the present invention may include either or both of exercise machine conversion 1503 and virtual object conversion 1504, and/or the functions may be combined into a single conversion between the sensor 1502 outputs and behavior of virtual object 1505. The specifics of the implementation of the invention will depend on which conversions 1503 and 1504 already exist, and/or the requirements of the simulation or game, as will be apparent to those of skill in the art.

For embodiments in which no virtual object is being controlled by the exercise experience, the exercise machine conversion 1503 is still preferably included, so that the exercise machine can be interfaced for classes, data comparisons, or other uses where the user's performance on one machine needs to be accurately compared to equivalent outputs of another type of machine.

Example Data Structures and Protocols to Provide the Conversion Functionality Such cross-exercise-machine and cross-virtual-object operations are achieved in the present invention through use of data protocols that encode data in the format expected for particular vehicles, virtual objects, or machines. One example is the Profile. Profile examples include both industry standard and invention-specific varieties, that describe characteristics and exercise machine motion parameters of the exercise machine, behavior parameters of the virtual object, and/or the user, and include factors such as physics parameters such as mass, area, dimensions, and other information relevant for algorithms in the invention to convert the quantities produced from the power output and others described earlier into quantities related to the virtual object being simulated.

The following are examples of an embodiment of the present invention for how it would interface to exercise machine protocol commands and data items, which are ways that commands are sent to an exercise machine and ways that an exercise machine can communicate motion or behavior parameters to an external system such as a simulation or game. The examples below show particular commands and data structures of the Bluetooth "Fitness Machine Service" protocol. The "Fitness Machine Service" protocol provides standardized data fields for various work out machines, such as a treadmill, indoor bike, and cross-trainer (or elliptical), which can be read by simulation or gaming software to set or update the simulated environment and person. From the above equations and discussions, a preferred embodiment calculates or derives the value for these data fields, based on the desired machines and virtual environments as specified in one or more profiles . . . Below lists just a few of the data fields and the related variables used to calculate the field value for the cross-trainer (elliptical) machine. This is expanded to additional data fields and other machines in other embodiments, as will be apparent to those with skill in the art.

- Cross Trainer Instantaneous Speed Field—calculated from gammaDot and gearRatio.
- Cross Trainer Average Speed Field—average Instantaneous Speed over the period of the current workout.
- Cross Trainer Instantaneous Power Field—calculated from gammaDot and rho.
- Cross Trainer Stride Count Field—calculated from gammaDot.
- Cross Trainer Step Per Minute Field—Stride Count averaged over a minute.
- Cross Trainer Total Energy Field—calculated from integrating the Instantaneous Power Field If the exercise machine is not the same type as "Cross Trainer" in this example, the exercise machine conversion 1503 would convert these fields as described above, according to a preferred embodiment. In addition to retrieving machine parameters, the "Fitness Machine Service" protocol enables a simulation or gaming software to set machine parameters via the "Fitness Machine Control Point" characteristic. These settable data fields are then used to update the variables or equations defining the user's machine, even when the machine lacks the capability of directly performing the requested task. Below lists some of the "Fitness Machine Control Point" data fields and the variables they could directly effect. Additional data fields could be incorporated to those with skill in the art.

- Set Target Inclination—adjust gearRatio if inclination can't be set directly.
- Set Target Resistance Level—adjust gearRatio as described above, if resistance of machine can't be set directly. Alternately, instruct the user to manually adjust the resistance level as specified.
- Set Indoor Bike Simulation Parameters—adjust wind speed, grade, coefficient of rolling resistance, wind resistance coefficients, either by setting resistance parameters, or by adjusting the gearRatio settings, using the techniques described above.

As above, exercise machine and virtual object conversion 1500 may be used if the motion parameters in the protocol are not intended for the type of exercise machine being used. Similar protocols to the above exist for other communication methods, such as ANT+, and calculating the analogous data fields analogously to the above description will be apparent to those with skill in the art. In addition, other communication methods are alternately used, such as USB or WiFi, to receive and set the machine data, either via standardized protocols or custom interfaces from machine vendors or simulation or gaming software.

In addition to interfacing to external systems during use, standards exist for sharing and comparing workout data. For example, file formats such as .fit, .gpx, and .tcx exist for sending workout data to databases, social networks, etc. A preferred embodiment of the present invention converts the data as described above and as derived from the sensors into these file formats. For example, the .gpx file format contains fields for power output and velocity, and hence this embodiment creates output files where for example, the power output and velocity fields are filled with data outputs calculated above. The techniques for creating, storing, and sharing files with such data will be apparent to those of skill in the art.

Overall Flow

Figure 17:
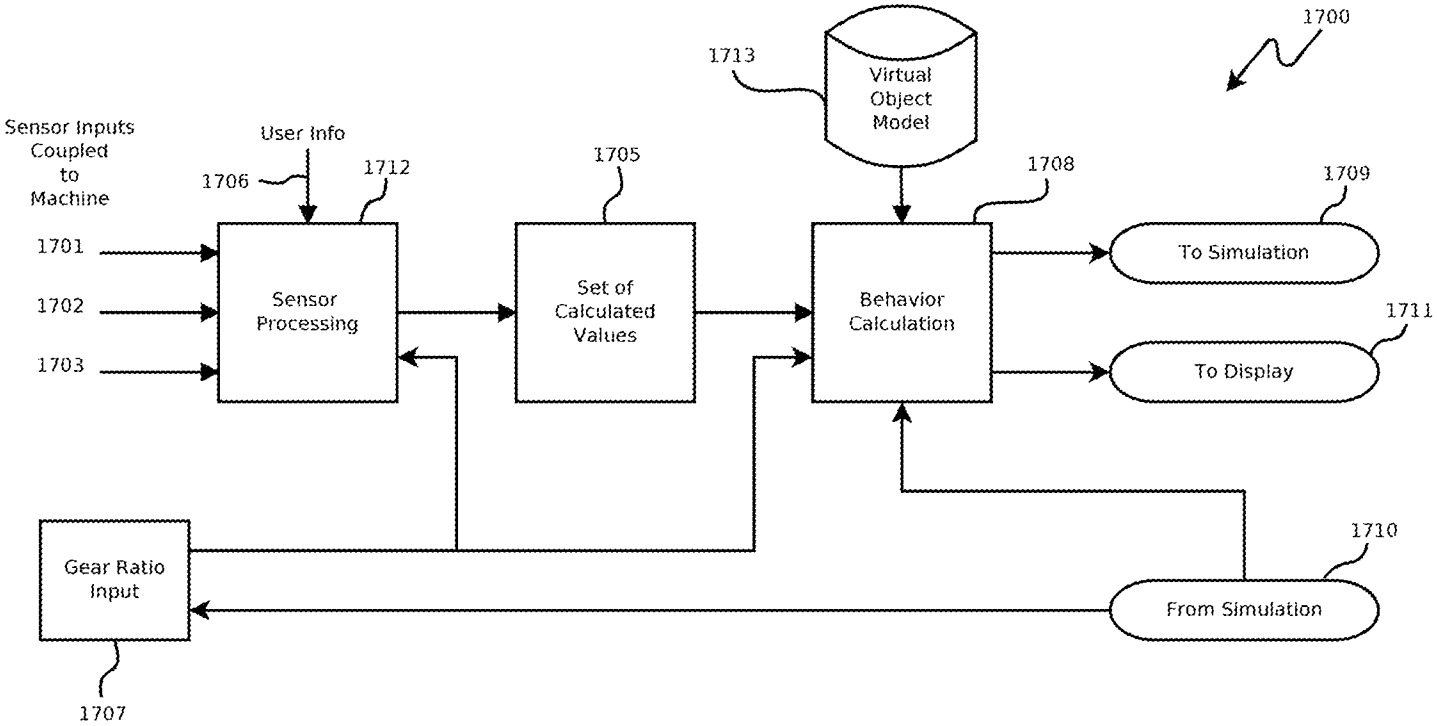
FIG. 17 depicts a block diagram of an exemplary overall flow of the present invention.

FIG. 17 shows a block diagram 1700 of the process, method, and structure showing an example of a perspective of how the present invention fits together. Accordingly, the steps that occur to make the parts of the invention work together are as described herein.

Sensor inputs 1701, 1702, and 1703 represent the sensor inputs as described previously, for example force sensors mounted between the feet of the machine and the floor, accelerometers, angular rate sensors, etc. While three are shown, any number of sensor inputs may be present in various embodiments of the present invention. Sensor Processing 1712 converts these raw sensor inputs into a set of calculated values 1705 that are more readily converted into the quantities needed by the simulation or game environment. For example, the calculated values could be the resistance rho, the rotational position and speed gamma and gamma dot, etc. Sensor Processing 1001 can be considered a more specific example of Sensor Processing 1712, in which workout intensity values, for example, rho and gamma dot, are computed from the forces and rotational quantities as shown for example in FIG. 10.

Sensor processing 1712 also preferably uses user info inputs 1706, with quantities such as the user's weight, age, gender, fitness level, VO2 max, etc., which may be helpful in converting between the sensor inputs 1701-1703 and the set of calculated values 1705, such as in the learning processes as described above, as additional inputs that may help to guide the calculations.

Gear ratio input 1707 can be used as an input to this process as described above, and may be combined with the other quantities in 1712 or 1705 to arrive at the calculated values in question. Alternately, gear ratio input 1707 could provide input to behavior calculation 1708 with an equivalent effect. Gear ratio input 1707 may be affected both by user input as well as from inputs from the simulation or game 1710, such as the incline of the slope being traversed in the simulation or game.

The calculated values 1705 are next used to calculate velocity or related quantities such as ascent and descent rates, positions, and accelerations in behavior calculation 1708. Behavior calculation 1708 computes whatever quantities are relevant for interfacing to the simulation or game, which outputs are provided to the simulation in the set of output quantities 1709, for example, the velocity of an object in a virtual path. Behavior calculation 1708 also bases its calculations on characteristics of the virtual object being simulated, such as weight, wind drag, etc., for example, based on the quantities depicted above in Equations 26 through 32. In a preferred embodiment, these characteristics and optionally, relationships between them, are stored in Virtual Object Model 1713. The process in 1708 may also optionally be affected by inputs from simulation 1710, such as the inclines, etc., depending on which algorithms in the system are used to reflect the response to the environment, such as is described above and will be apparent to those of skill in the art. Behavior calculation 1708 may also provide outputs directly to the user through display outputs 1711. Examples of this include the gear ratio output described above, which could be in additional to the game/simulation outputs, or power generated output, which may be of interest for athletic training, but which may not be readily available from simulations, games, or the unmodified machine. Calories burned could also be calculated using similar techniques, for example by combining the power output with relations known in the art on the efficiency of the human body in producing power for various activities, cadence values, and human characteristics.

Some Alternate Embodiments of the Present Invention

Figure 18:
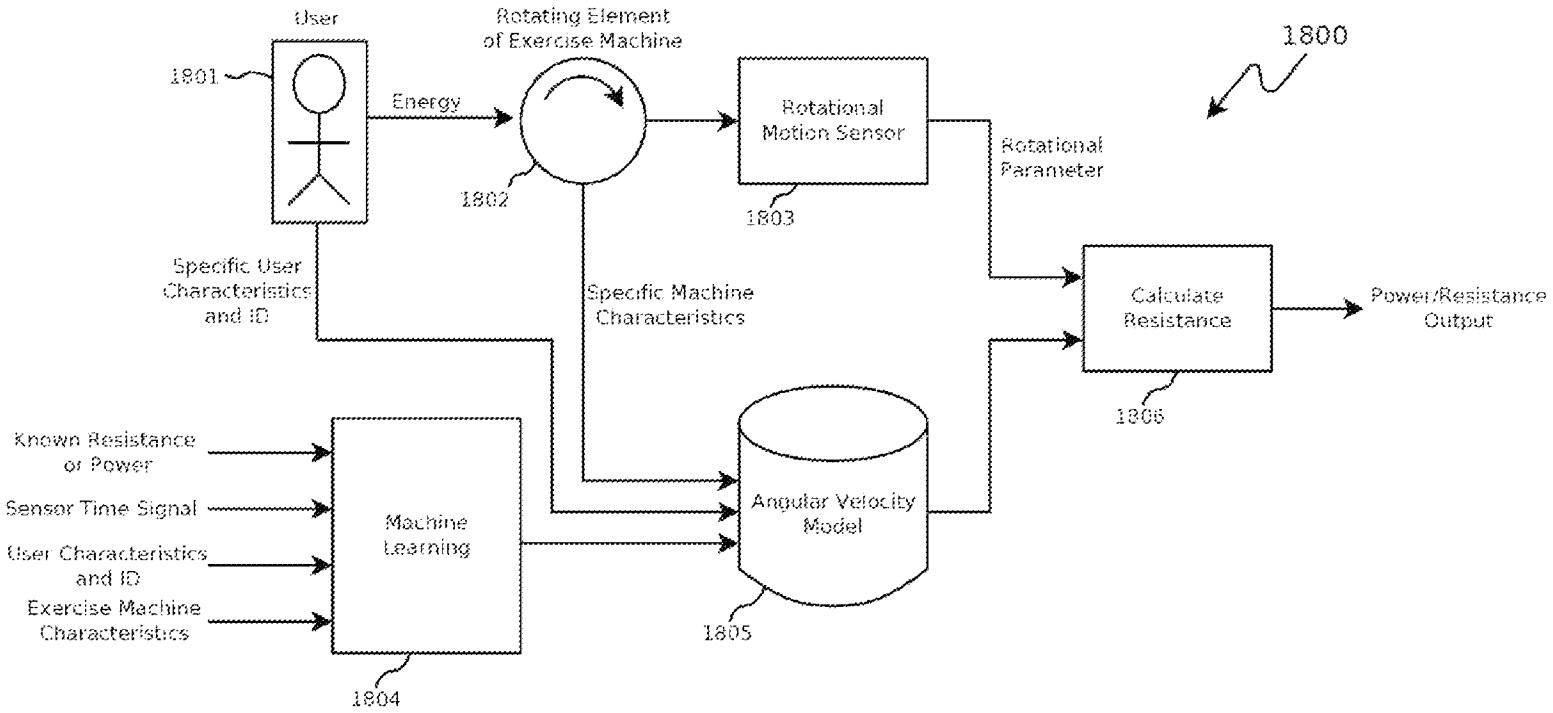
FIG. 18 depicts an embodiment that calculates exercise machine resistance or power output from data about the variability in angular rate of a component of an exercise machine.

An alternative embodiment for calculating relative power of a system is to monitor the variations in angular velocity during system use, as depicted in FIG. 18. In various embodiments according to FIG. 18, angular velocity is measured by a sensor to output the angular velocity of the object, or a sensor can to output the angular acceleration of the object. Alternatively, the angular acceleration is derived from the angular velocity, or the angular velocity can be derived from the angular acceleration, as will be apparent to those of skill in the art.

For a user to maintain constant average rotational characteristics of the rotating element of the exercise machine, the user must apply an average torque equal to the system's average resistance torque across each cycle. However, the higher the resistance, the less likely the user will be able to apply uniform forces to the machine mechanisms, due to changes in the required force vectors during the cycle and those interactions with the user's biomechanics. For example, during pedaling of an elliptical, it is very difficult to apply power to a pedal during the portion of the pedaling cycle where the pedal is moving upward. Thus, the difference in the maximum and minimum of angular velocity within a cycle will be greater the higher the resistance torque.

One alternate embodiment of the present invention shown in FIG. 18 depicts an angular velocity based interface system 1800, which performs a calibration procedure to map the angular velocity variation to system resistance, and/or user power. For this embodiment, the mapping between variability in angular rate vs. power or resistance is preferably created by collecting data on a per-user or per-machine basis, such as the known resistance or power and the sensor time signal, inputs of machine learning 1804, then applying curve fitting, numerical methods, or machine learning to provide the needed mathematical relationships. The result of machine learning 1804 is an angular velocity model 1805. Once calibrated, the sensor readings measured by rotational motion sensor 1803 from the rotating element of exercise machine 1802 are processed by calculate resistance process 1806, for example, the application of the learned angular velocity model 1805 that maps sensor readings to resistance values. This process in calculate resistance block 1806 produces the power/resistance output, depending on the machine learning 1804 inputs and outputs.

As possible in other embodiments of calibration techniques described herein, an alternate embodiment of the present invention collects data about characteristics of the user 1801, such as age, weight, height, gender, fitness level, and workout history, and also optionally about large numbers of exercise machines, such as their brand, dimensions, price range, etc., to improve the algorithms and create a better mapping. This is shown by the additional, optional inputs user characteristics and ID, and exercise machine characteristics, of machine learning 1804. When enough data are collected in this manner, this embodiment uses machine learning techniques known in the art and creates mappings that do not require recalibration per user or optionally per machine, being able to produce adequate outputs on the basis of entry of the above user parameters. This is shown in FIG. 18 as the specific user characteristics and ID input and the specific machine characteristics input to angular velocity model 1805.

Figure 19:
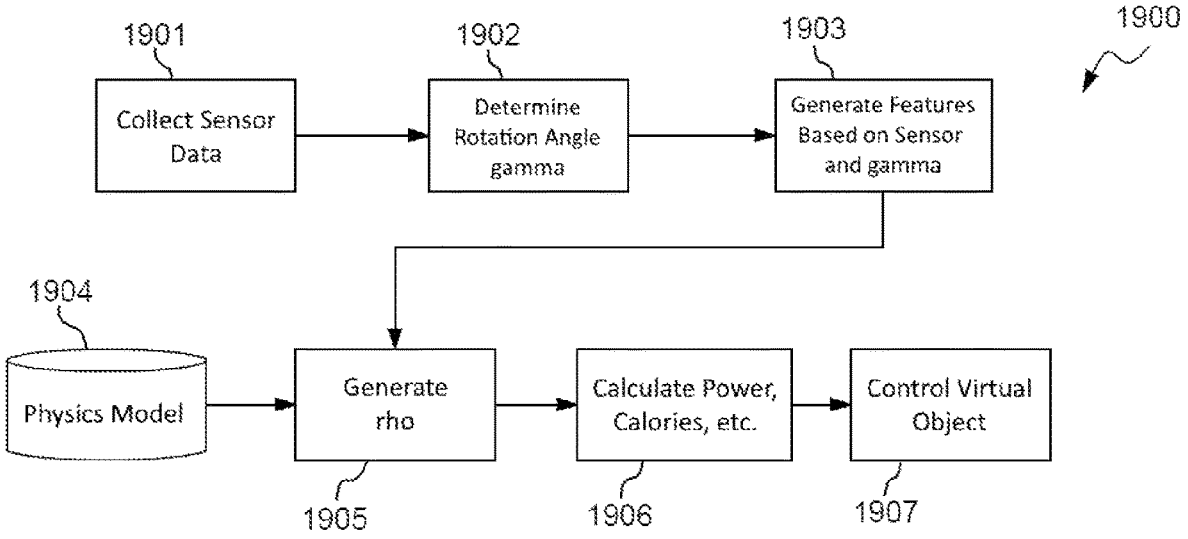
FIG. 19 depicts the flow of steps in an example method for controlling a simulated vehicle by an embodiment of the present invention.

FIG. 19 summarizes an example method 1900 for computing outputs such as power output and calories burned and/or controlling a virtual object according to the present invention. Some of the blocks may be omitted for a particular embodiment if those parts of the method are not needed for the particular results needed. Collect sensor data 1901 involves getting sensor data from the motion of the exercise machine, using various of the techniques described above, for example force and/or angular rate sensors. Determine rotation angle gamma 1902 involves calculating the angle of a movable part of the exercise machine, such as a flywheel, belt, linkage, etc. as described previously. Generate features 1903 involves extracting or modifying parts of the data collected in collect sensor data 1901 so as to correlate it with the rotation angle gamma. However, if sufficient data is available in the physics model 1904, the rotation angle gamma may not be required, making blocks 1902 and 1903 optional. Generate rho 1905 involves using the physics model 1904 of relationships between the resistance setting of the machine and the motion of the machine to infer the resistance rho, as described above. Equivalently, the model may represent the power output, calories, burned, etc. directly, in which embodiments, generate rho 1905 may be optional. calculate power, calories, etc. 1906 involves converting the resistance rho, gamma information, or other information derived from the process of collect sensor data 1901 into quantities of direct interest to the user, a workout, or a simulation or gaming environment, based on the techniques and math described above. Finally control virtual object 1907 involves converting the motion, power, etc. quantities derived in block 1906 into velocity, position, skill level etc. of a virtual object as described above. For installations where the quantities derived in block 1906 are of interest and a virtual object is not part of the workout experience, block 1907 may be optional.

Another alternate embodiment of the present invention applies techniques such as described above for quantities other than angular motion. For example, embodiments use vibration characteristics, audio characteristics, heat production, etc., mapping them to power output and other characteristics using analogous techniques.

An alternate embodiment of the invention provides exercise machine conversion 1503 and/or virtual object conversion 1504 without the need for including sensor processing 1502, for example, to interface existing exercise machines that already have power or resistance outputs with existing simulations, games, or other workout environments that are designed to receive input from a different type of exercise machine.

Instead of a simulation or game, a simplified embodiment of the present invention provides additional data outputs to the user, such as power output or calories burned, which will be provided using the above techniques and will be apparent to those with skill in the art, given the above descriptions of the algorithms. Such an interface may be used, for example, in a class environment, where the instructor indicates a resistance setting and the machine measures and displays cadence, power output and integrates to display energy output.

The various embodiments of algorithms, modules, and structure may be implemented in various formats, including custom analog and/or digital electronics, by a processing device, such as software in a computer, firmware in microcontrollers or other computing hardware, or portable devices such as phones, tablets, watches, etc.

This specification represents the preferred embodiment of the invention. The concepts of the present invention are not necessarily divided into the modules and steps illustrated by example here, but could be divided into different sections, performed in somewhat different orders, etc. There are many alternate embodiments, such as alternate equations and filtering technique refinements that fall within the scope of the invention that will be apparent to those with skill in the art, once the principles of the invention are understood.

While there has been illustrated and described what is at present considered to be the preferred embodiment of the subject invention, it will be understood by those skilled in the art that various changes and modifications may be made and equivalents may be substituted for elements thereof without departing from the true scope of the invention.

What is claimed is:

1. A system for interfacing to an exercise machine of the type that has support feet and a resistance setting, the system comprising:

a sensor configured to be placed under a support foot of the exercise machine and configured to output a sensor signal on the basis of forces on the sensor;

a processing device configured to receive the sensor signal and comprising a memory device, the memory device storing a program code that when executed by the processing device, causes the processing device to perform operations, wherein the program code comprises an exercise machine physics model program code comprising information about a mathematical relationship between forces on the support foot of the exercise machine and power-output values and/or the resistance setting, and wherein the program code further comprises a sensor processing program code configured to receive the sensor signal, to output the sensor signal to the exercise machine physics model program code, and to output a workout-intensity signal comprising a measurement related to workout intensity of exercise on the exercise machine on the basis of the sensor signal and the exercise machine physics model;

wherein the processing device further comprises an output interface configured to output an output signal on the basis of the workout-intensity signal.

2. The system of claim 1, further comprising a rotation sensor attached to a moving member of the exercise machine and configured to output a rotation signal, wherein the processing device is further configured to receive the rotation signal, and wherein the sensor processing program code is further configured to receive the rotation signal and to output an exercise machine angle signal on the basis of the rotation signal, and wherein the sensor processing program code is further configured to output the workout-intensity signal on the basis of the exercise machine angle signal.

3. The system of claim 1, further comprising an angle estimation program code configured to receive the sensor signal and to extract a periodic sensor signal from the sensor signal, and wherein the angle estimation program code comprises a reference sensor waveform, and wherein the angle estimation program code is further configured to output an exercise machine angle signal on the basis of a comparison of the reference sensor waveform with the periodic sensor signal, and wherein the sensor processing program code is further configured to output the workout-intensity signal on the basis of the exercise machine angle signal.

4. The system of claim 1, wherein the sensor processing program code is further configured to output a resistance signal comprising an estimate of the resistance setting on the basis of the sensor signal, and wherein the sensor processing program code is further configured to output the workout-intensity signal on the basis of the resistance signal.

5. The system of claim 3, wherein the sensor processing program code further comprises a trigonometric function program code, wherein the trigonometric function program code is configured to receive the exercise machine angle signal and to output a trigonometric function signal on the basis of the exercise machine angle signal, and wherein the exercise machine physics model program code comprises information about a mathematical relationship between the trigonometric function signal and power-output values and/or the resistance setting.

6. The system of claim 1, wherein the program code further comprises a reference training profile comprising a time series of values of the resistance setting, and wherein the program code further comprises a calibration program code configured to receive the sensor signal and the reference training profile, and wherein the calibration program code is further configured to output information into the physics model program code on the basis of the sensor signal and the reference training profile, whereby the sensor processing program code can output the workout-intensity signal on the basis of the sensor signal and the reference training profile.

7. The system of claim 6, wherein the calibration program code comprises a machine learning program code.

8. The system of claim 1, wherein the program code further comprises a virtual path program code, and wherein the processing device is further configured to receive an incline signal representing inclination of the virtual path program code, and wherein the program code further comprises a virtual object model program code comprising weight information, and further comprises a velocity-calculation program code configured to receive the workout-intensity signal and the incline signal and to output a simulated-velocity signal on the basis of the virtual object model program code, the workout-intensity signal, and the incline signal.

9. The system of claim 1, wherein the system further comprises a second sensor configured to be placed under a second support foot of the exercise machine and configured to output a second sensor signal on the basis of forces on the second support foot, and wherein the sensor signal further comprises information about the second sensor signal, whereby the sensor processing program code can provide its outputs on the basis of both the sensor and the second sensor.

10. A method for interfacing to an exercise machine of the type that has support feet and a resistance setting, the method comprising:

placing a sensor to be in contact with a support foot of the exercise machine, providing a physics model comprising information about mathematical relationships between forces on the support foot and motions of the exercise machine and further comprising positional information about the sensor relative to the exercise machine, receiving a force signal from the sensor, calculating a resistance signal comprising an estimate of the resistance setting on the basis of the force signal and the physics model, and calculating and outputting a workout-intensity signal comprising a measurement related to workout intensity of exercise on the exercise machine on the basis of the force signal, the physics model, and the resistance signal.

11. The method of claim 10, further comprising placing a rotation sensor on the exercise machine and receiving a rotation signal from the rotation sensor, wherein the calculating and outputting the workout-intensity signal further comprises calculating the workout-intensity signal on the basis of the rotation signal and further comprises outputting the workout-intensity signal on the basis of the rotation signal.

12. The method of claim 10, wherein the calculating and outputting the workout-intensity signal further comprises providing a Bluetooth and/or ANT+ interface and outputting a Bluetooth and/or ANT+ signal comprising a power-output signal on the basis of the calculating the resistance signal.

13. The method of claim 10, further comprising extracting a periodic waveform signal from the force signal, providing a reference waveform signal, and calculating an exercise machine angle on the basis of comparing the reference waveform signal with the periodic waveform signal, and wherein the calculating the resistance signal comprises calculating a trigonometric function on the basis of the exercise machine angle.

14. The method of claim 10, further comprising performing a calibration, comprising providing a reference training profile comprising a time series of values of the resistance setting, and producing a reference signal on the basis of the reference training profile, and wherein the providing the physics model comprises providing mapping information on the basis of relating the force signal and the reference signal.

15. The method of claim 14, wherein the providing the physics model comprises providing a machine-learning program code, and wherein the providing mapping information comprises training the machine-learning program code on the basis of the reference signal and the force signal.

16. The method of claim 10, further comprising providing a virtual object model program code, providing an inclination signal representing inclination of motion of the virtual object model program code, and calculating and outputting a velocity signal on the basis of the virtual object model program code, the inclination signal, and the receiving the force signal.

17. The method of claim 10, further comprising placing a second sensor under a second support foot of the exercise machine, receiving a second force signal from the second sensor, and augmenting the force signal on the basis of the second force signal, whereby the calculating and outputting the workout-intensity signal can proceed on the basis of both the placing the sensor and the placing the second sensor.

* * * * *